US010563418B2

(12) United States Patent
Pall

(10) Patent No.: US 10,563,418 B2
(45) Date of Patent: Feb. 18, 2020

(54) FRICTION DAMPER FOR A BUILDING STRUCTURE

(71) Applicant: Avtar Pall, Dollard-des-Ormeaux (CA)

(72) Inventor: Avtar Pall, Dollard-des-Ormeaux (CA)

( * ) Notice: Subject to any disclaimer, the term of this patent is extended or adjusted under 35 U.S.C. 154(b) by 0 days.

(21) Appl. No.: 16/425,837

(22) Filed: May 29, 2019

(65) Prior Publication Data

US 2019/0383053 A1 Dec. 19, 2019

Related U.S. Application Data

(63) Continuation of application No. 15/843,189, filed on Dec. 15, 2017, now Pat. No. 10,323,430.

(51) Int. Cl.

| | |
|---|---|
| ***E04H 9/02*** | (2006.01) |
| ***E04B 1/24*** | (2006.01) |
| ***E04B 1/92*** | (2006.01) |

(52) U.S. Cl.

CPC ..... *E04H 9/021* (2013.01); *E04B 1/2403* (2013.01); *E04B 1/92* (2013.01); *E04H 9/024* (2013.01); *E04B 2001/2415* (2013.01); *E04B 2001/2439* (2013.01); *E04B 2001/2451* (2013.01); *E04B 2001/2457* (2013.01); *E04B 2103/06* (2013.01)

(58) Field of Classification Search

CPC . E04H 9/021; E04H 9/024; E04B 1/92; E04B 1/2403; E04B 2001/2415; E04B 2001/2457; E04B 2001/2451; E04B 2001/2439; E04B 2103/06

See application file for complete search history.

(56) References Cited

U.S. PATENT DOCUMENTS

| | | | |
|---|---|---|---|
| 4,409,765 | A | 10/1983 | Pall |
| 4,929,008 | A | 5/1990 | Esfandiary |
| 5,660,017 | A | 8/1997 | Houghton |
| 6,138,427 | A | 10/2000 | Houghton |

(Continued)

FOREIGN PATENT DOCUMENTS

| | | | |
|---|---|---|---|
| CA | 1 150 474 | A | 7/1983 |

OTHER PUBLICATIONS

A. Ravi Kiran et al., "Seismic Retrofitting of a Process Column using Friction Dampers", Elsevier, ScienceDirect, May 26, 2016, Procedia Engineering 144, pp. 1356-1363.

(Continued)

*Primary Examiner* — Rodney Mintz

(74) *Attorney, Agent, or Firm* — Fitch, Even, Tabin & Flannery LLP

(57) ABSTRACT

A multi-load friction damper includes opposed gusset-side plates defining a slip channel. First and second brace-side plates are received within the slip channel and form first and second frictional engagements respectively. The frictional force of the first and second frictional engagements may be different. A multi-layer friction damper includes a central gusset-side plate and first and second outer gusset-side plates. First and second brace-side plates are received between the central gusset-side plates and the first and second outer gusset-side plates to form first, second, third and fourth frictional engagements. A multi-damper assembly includes a gusset engagement member and brace engagement member. A plurality of friction dampers extend between the gusset engagement member and the brace engagement member.

11 Claims, 26 Drawing Sheets

(56) References Cited

U.S. PATENT DOCUMENTS

| | | | | |
|---|---|---|---|---|
| 6,516,583 | B1 | 2/2003 | Houghton | |
| 6,561,736 | B1 | 5/2003 | Doleshal | |
| 6,735,919 | B1 | 5/2004 | diGirolamo et al. | |
| 8,250,818 | B2 * | 8/2012 | Tremblay | E04H 9/02 52/1 |
| 8,807,307 | B2 | 8/2014 | Choi | |
| 8,881,491 | B2 * | 11/2014 | Christopoulos | E04H 9/022 52/741.3 |
| 9,133,641 | B2 | 9/2015 | Choi | |
| 9,316,014 | B2 | 4/2016 | Chou et al. | |
| 9,322,170 | B2 | 4/2016 | Tsai | |
| 9,322,171 | B2 | 4/2016 | Tsai | |
| 9,506,239 | B2 * | 11/2016 | Houghton | E04B 1/2403 |
| 10,184,244 | B2 * | 1/2019 | Choi | E04H 9/02 |
| 10,280,642 | B2 * | 5/2019 | Zhao | E04H 9/021 |
| 10,323,430 | B1 * | 6/2019 | Pall | E04H 9/021 |
| 2002/0166306 | A1 | 11/2002 | Wilson | |
| 2008/0016794 | A1 * | 1/2008 | Tremblay | E04H 9/02 52/167.4 |
| 2012/0138402 | A1 | 6/2012 | Choi | |
| 2014/0326557 | A1 | 11/2014 | Choi | |
| 2015/0275501 | A1 * | 10/2015 | Houghton | E04B 1/2403 52/854 |
| 2016/0356033 | A1 * | 12/2016 | Houghton | E04B 1/2403 |
| 2018/0202151 | A1 | 7/2018 | Choi | |
| 2019/0040645 | A1 * | 2/2019 | Zhao | E04H 9/021 |
| 2019/0106875 | A1 * | 4/2019 | Houghton | E04B 1/2403 |
| 2019/0186165 | A1 * | 6/2019 | Pall | E04H 9/021 |

OTHER PUBLICATIONS

Avtar Pall and R. Tina Pall, "Performance-Based Design Using Pall Friction Dampers—An Economical Design Solution", 13th World Conference on Earthquake Engineering, Vancouver, British Columbia, Canada, Aug. 1-6, 2004, Paper No. 1955, 15 pages.

Alfred Tjahyadi, "Slotted-Boiled Friction Damper as a Seismic Energy Dissipator in a Braced Timber Frame", Thesis for the degree of Master of Science in Wood Science and Civil Engineering presented on Mar. 8, 2002, 232 pages.

Protest Filed Under Section 34.1 of the Patent Act, CA 2,989,025, "Friction Damper for a Building Structure", Dec. 21, 2018, 18 pages.

* cited by examiner

FRICTION DAMPER FOR A BUILDING STRUCTURE

CROSS-REFERENCE TO RELATED APPLICATION

This application is a continuation of U.S. patent application Ser. No. 15/843,189 filed Dec. 15, 2017, the entire contents of which is incorporated herein by reference.

TECHNICAL FIELD

The present disclosure generally relates to improvements to friction dampers and friction damper assemblies used in building structures.

BACKGROUND

Friction dampers developed by Dr. Avtar Pall have been widely used in the construction industry since the 1980s. The friction dampers are effective for seismic control of buildings, i.e. making the buildings more resistant to forces from earthquakes.

The designs of the friction damper are described in Canadian patent no. 1,150,474 and U.S. Pat. No. 4,409,765. The friction dampers are installed in the structure of the building and operate by converting seismic energy from earthquakes into friction/heat.

FIG. 1A illustrates a side elevation view of prior art friction damper 1. FIGS. 1B, 1C, 1D illustrate section views along the lines 1-1, 2-2, and 3-3 of FIG. 1A, respectively. The prior art friction damper 1 includes a pair of opposed gusset-side plates 4 that are spaced apart to define a slip channel 8 therebetween (see FIG. 1C). The proximal end region 12 of the gusset-side plates 4 are engageable with a gusset of a building structure. For example, and as illustrated, the proximal end region 12 include openings 16 for attachment to the gusset of the building structure.

The gusset-side plates 4 extend along and define a bracing axis 20. Accordingly, the slip channel 8 also extends along the bracing axis 20.

The cross-section at line 2-2, as illustrated in FIG. 1C corresponds to a first non-overlapping portion 24 of the friction damper 1 and the length of the slip channel 8 corresponding to this first non-overlapping portion 24 is unoccupied when the friction damper 1 is in its non-slip state, thereby defining a clear space within the slip channel 8.

The prior art friction damper 1 includes a brace-side plate 28. A proximal end region 32 of the brace-side plate 28 is engageable with a brace of the building structure. The brace-side plate 28 extends along, and is aligned with, the bracing axis 20. The brace-side plate 28 is also partially received within the slip channel 8.

The cross-section at line 3-3, as illustrated in FIG. 1D corresponds to a second non-overlapping portion 36 of the friction damper 1 and a length of the brace-side plate 28 is not overlapping with the gusset-side plates when the friction damper 1 is in its non-slip state.

The cross-section at line 1-1, as illustrated in FIG. 1B corresponds to an overlapping portion 40 of the friction damper 1 in which a length of the brace-side plate 28 overlaps with the gusset-side plates 4. Frictional engagements are formed between friction surfaces of the brace-side plate 28 with friction surfaces of the gusset-side plates 4. More particularly, a first outer friction surface 44 of the brace-side plate 28 forms a first frictional engagement with an inner surface 48 of a first of the gusset-side plates 4. A second outer friction surface 52 of the brace-side plate 28 forms a second frictional engagement with an inner friction surface 54 of a second of the gusset-side plates 4. The friction surfaces of the brace-side plate 28 and gusset-side plates 4 are treated to improve the frictional engagement.

As illustrated in FIG. 1B, a first clamping member 60 is disposed on the outer surface of the first of the gusset-side plates and a second clamping member 64 is disposed on the outer surface of the second of the gusset-side plates. Fasteners 68 extend through openings of the gusset-side plates 4, brace-side plate 28 and clamping members 60, 64 to fasten the clamping members 60, 64 together. The clamping by the fasteners 68 apply a normal force on the surfaces of the brace-side plate 28 and gusset-side plates 4, thereby causing the frictional engagements thereof.

In a non-slip state, as illustrated in FIG. 1A, frictional engagements of the friction surfaces of the brace-side plate 28 and the gusset-side plates 4 is maintained. The frictional force of the frictional engagements is sufficiently high to maintain the frictional engagement under seismic forces applied along the bracing axis 20 (compression or tension) within the building structure (i.e. when an earthquake is not occurring).

When a seismic force (compression or tension from an earthquake) applied along the bracing axis 20 is greater than the frictional force of the frictional engagement, the brace-side plate 28 and the gusset-side plates 4 slip relative to one another. FIG. 1E is a hysteresis loop showing the slip load from the slip length (length of travel of the plate 28 relative to plates 4). It will be appreciated that when the brace-side plate 28 and the gusset-side plates 4 slip relative to one another, the energy applied along the bracing axis 20 from the earthquake is converted to friction heat from the engagement between the surfaces 44, 52 of the brace-side plate 28 and surface 48, 54 of the gusset-side plates. This conversion of energy reduces the forces on other parts of the building structure, thereby improving building integrity during the earthquake.

SUMMARY

According to one aspect, there is provided a multi-load friction damper for a building structure. The friction damper includes a pair of opposed gusset-side plates defining a slip channel therebetween, the slip channel further defining a bracing axis, a first brace-side plate having a proximal end and a distal end, the first brace-side plate being received within the slip channel, extending along the bracing axis, and being pinched between the pair of opposed gusset-side plates to form a first frictional engagement, and a second brace-side plate having a distal end facing the proximal end of the first brace-side plate, the second brace-side plate being received within the slip channel, extending along the bracing axis, being aligned with the first brace-side plate, and being pinched between the pair of opposed gusset-side plates to form a second frictional engagement, the distal end thereof being spaced apart from the proximal end of the first brace-side plate when in a non-slip state.

In some example embodiments, a lateral surface of each of the pair of opposed gusset-side plates each comprise a friction surface portion, lateral surfaces of the first brace-side plate each have friction surface portions and wherein contact of the friction surface portions of the first-brace side plate with friction surface portions of the opposed gusset-side plates form the first frictional engagement, and lateral surfaces of the second brace-side plate each have friction surface portions and wherein contact of the friction surface portions of the second-brace side plate with friction surface portions of the opposed gusset-side plates form the second frictional engagement.

In some example embodiments, the first frictional engagement has a first frictional force and the second frictional engagement has a second frictional force being less than the first frictional force.

In some example embodiments, a first load applied on the friction damper along the bracing axis and being greater than the second frictional force and less than the first frictional force causes the second brace-side plate to enter a first slipping state, whereby the second brace-side plate is slipping towards the first brace-side plate.

In some example embodiments, the distal end of the second brace-side plate abuts the proximal end of the first brace-side plate following slipping of the second brace-side plate while in the first slipping state.

In some example embodiments, wherein a second load applied on the friction damper along the bracing axis and being greater than the first frictional force causes the first brace-side plate and the second brace-side plate to enter a second slipping state, whereby the first brace-side plate and the second brace-side plate are slipping in a direction of the distal end of the first brace-side plate.

In some example embodiments, the friction damper further includes a first clamping member disposed on an outer surface of a first of the opposed gusset-side plates, a second clamping member disposed on an outer surface of a second of opposed gusset-side plates and a plurality of fastening members fastening the first clamping member to the second clamping member, thereby applying a normal force causing the first frictional force and the second frictional force.

According to another aspect, there is provided a multi-layer friction damper for a building structure. The multi-layer friction damper includes a central gusset-side plate having a first friction surface and a second friction surface and defining a bracing axis, a first outer gusset-side plate extending along the bracing axis and having an inner friction surface opposing the first friction surface of the central gusset-side plate and defining a first slip channel therebetween, a second outer gusset-side plate extending along the bracing axis and having an inner friction surface opposing the second friction surface of the central gusset-side plate and defining a second slip channel therebetween, a first brace-side plate extending along the bracing axis and having an inner surface and an outer surface, the first brace-side plate being received within the first slip channel, the inner surface of the first brace-side plate forming a first frictional engagement with the first friction surface of the central gusset-side plate and the outer surface of the first brace-side plate forming a second frictional engagement with the inner friction surface of the first outer gusset-side plate, and a second brace-side plate extending along the bracing axis and having an inner surface and an outer surface, the second brace-side plate being spaced apart from the first brace-side plate to define a third slip channel therebetween, the central gusset-side plate being received within the third slip channel and the second brace-side plate further being received within the second slip channel, the inner surface of the second brace-side plate forming a third frictional engagement with the second friction surface of the central gusset-side plate and the outer surface of the first brace-side plate forming a fourth frictional engagement with the inner friction surface of the second outer gusset-side plate.

In some example embodiments, the first frictional engagement, the second frictional engagement, the third frictional engagement, and the fourth frictional engagement define a combined frictional force and under a load greater than the combined frictional force, the first brace-side plate slips within the first slip channel, the second brace-side plate slips within the second slip channel, and the central gusset-side plate slips within the third channel.

In some example embodiments, the slipping of the first brace-side plate, the slipping of the second brace-side plate and the slipping of the central gusset-side plate occur together.

In some example embodiments, a first clamping member disposed on an outer surface of the first outer gusset-side plate, a second clamping member disposed on an outer surface of the second outer gusset-side plate and a plurality of fastening members fastening the first clamping member to the second clamping member, thereby applying a normal force on each of the central gusset-side plate, the first outer gusset-side plate, the second outer gusset-side plate, the first brace-side plate and the second brace-side plate.

In some example embodiments, the plurality of fastening members comprises three or more rows of fasteners arranged in a direction transverse to the bracing axis.

According to yet another aspect, there is provided a multi-layer friction damper for a building structure. The friction damper includes a set of at least one inner gusset-side plate extending defining a bracing axis, the set having a first outermost friction surface and a second outermost friction surface, a first outer gusset-side plate extending along the bracing axis and having an inner friction surface opposing the first outermost friction surface and defining a first slip channel therebetween, a second outer gusset-side plate extending along the bracing axis, the second outer gusset-side plate having an inner friction surface opposing the second outermost friction surface and defining a second slip channel therebetween, and a set of a plurality of brace-side plates extending along the bracing axis, the set having a first outermost brace-side plate and a second outermost brace-side plate, and a pair of adjacent brace-side plates of the set being spaced apart to define a third slip channel, one of the set of at least one inner gusset-side plate being received within the third slip channel and being pinched between the pair of adjacent brace-side plates and a first outermost brace-side plate being received within the first slip channel and a second outermost brace-side plate being received within the second slip channel.

According yet another aspect, there is provided a multi-damper assembly for a building structure. The assembly includes a gusset engagement member, a brace engagement member defining a bracing axis, and a plurality of friction dampers. Each friction damper has a pair of opposing gusset-side plates extending from the gusset engagement member along the bracing axis towards the brace engagement member, the plates being spaced apart to define a slip channel and a brace-side plate extending from the brace engagement member along the bracing axis towards the gusset engagement member, the brace-side plate being received within the slip channel and being pinched between the pair of opposing gusset-side plates.

In some example embodiments, the brace engagement member comprises a cross-plate member oriented in a direction transverse to the bracing axis, the brace-side plates of the plurality of the friction dampers extending from a surface of the cross-plate member.

In some example embodiments, the plurality of friction damper comprises a first set of at least two friction dampers arranged side by side in a direction transverse to bracing axis.

In some example embodiments, the plurality of friction dampers further comprises a second set of at least two friction dampers arranged side by side in the direction transverse to the bracing axis, the first and second set of friction dampers further being arranged one atop another in a heightwise direction of the friction damper.

In some example embodiments, within each friction damper, the brace-side plate has a first friction surface and a second friction surface and each of the pair of gusset-side plates has an inner friction surface, the first friction surface of the brace-side plate forms a first frictional engagement of the damper with the inner surface of one of the gusset-side plates and the second friction surface of the brace-side plate forms a second frictional engagement of the damper with the inner surface of the other of the gusset-side plates, the first and second frictional engagements of each of the plurality of friction dampers define a combined frictional force, and the brace-side plates slip together within their respective slip channels under a load greater than the combined frictional force.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1A:
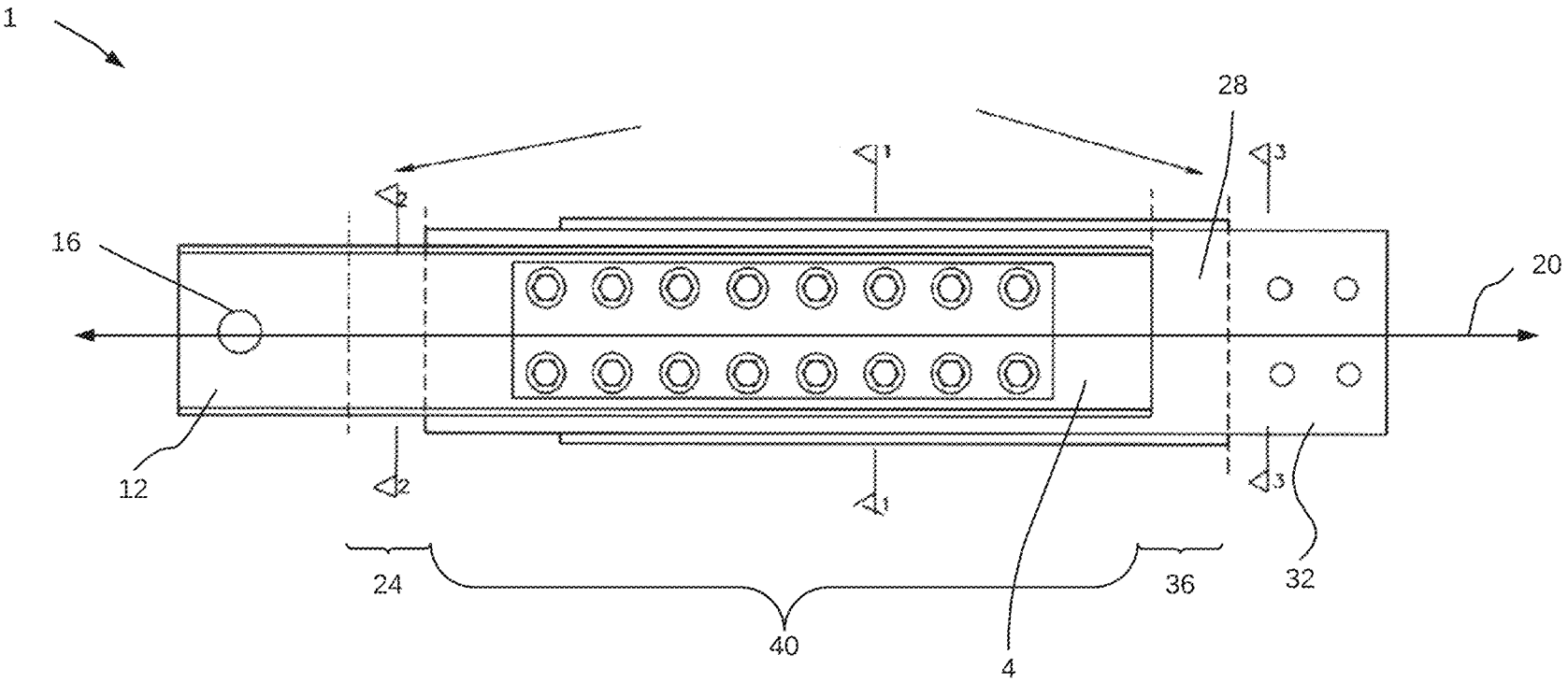
FIG. 1A (Prior Art)
FIG. 1A illustrates a side elevation view of a prior art friction damper.
Figure 1B:
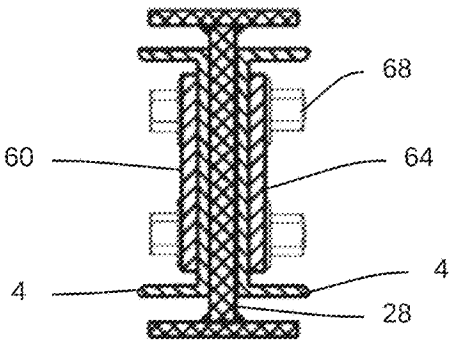
FIG. 1B (Prior Art)
FIG. 1B illustrates a section view of the prior art friction damper along the line 1-1 of FIG. 1A.
Figure 1C:
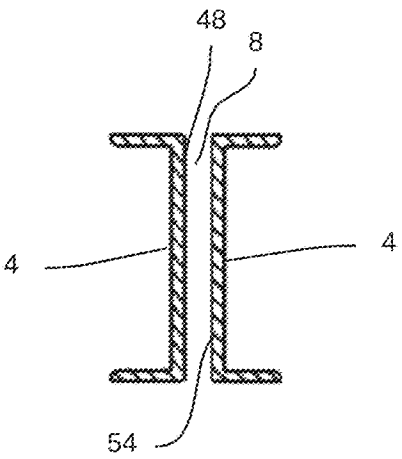
FIG. 1C (Prior Art)
FIG. 1C illustrates a section view of the prior art friction damper along the line 2-2 of FIG. 1A.
Figure 1D:
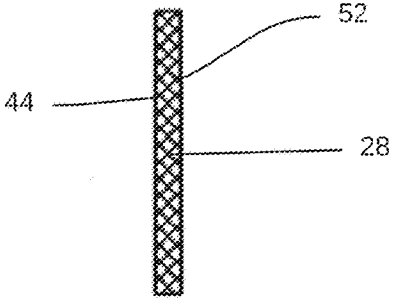
FIG. 1D (Prior Art)
FIG. 1D illustrates a section view of the prior art friction damper along the line 3-3 of FIG. 1A.
Figure 1E:
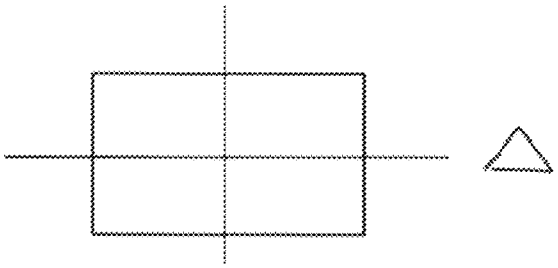
FIG. 1E (Prior Art)
FIG. 1E illustrates a graph of a hysteresis loop showing slip load vs slip length for the prior art friction damper.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

The terms "coupled" or "coupling" as used herein can have several different meanings depending in the context in which these terms are used. For example, the terms coupled or coupling can have a mechanical connotation. For example, as used herein, the terms coupled or coupling can indicate that two elements or devices are directly connected to one another or connected to one another through one or more intermediate elements or devices via a mechanical element depending on the particular context.

The terms "brace-side" and "gusset-side" are used herein to denote sides of friction dampers described herein in accordance with the coupling of these sides within a building structure. The friction dampers described herein are intended for use as part of a brace within the building structure.

The brace-side of the friction damper couples, either directly or via an intermediate member, to a first location of the building structure. In the examples described herein, and illustrated in FIGS. 2J and 3J, the brace side is coupled to a brace member, which can further couple to the first location of the building structure, such as a beam or column.

The gusset-side of the friction damper couples, either directly or via an intermediate member, to a second location of the building structure. In the examples described herein, and illustrated in FIGS. 2J and 3J, the gusset side is coupled directly to the second location of the building structure, such as a beam or column.

However, it will be understood that the terms "brace-side" and "gusset-side" can be used interchangeably. According to some alternative embodiments, plates described herein and denoted as "brace-side plates" can be configured to be coupled to a gusset of the building structure while plates described herein and denoted herein as "gusset-side plates" can be configured to be coupled to a brace of the building structure.

Figure 2A:
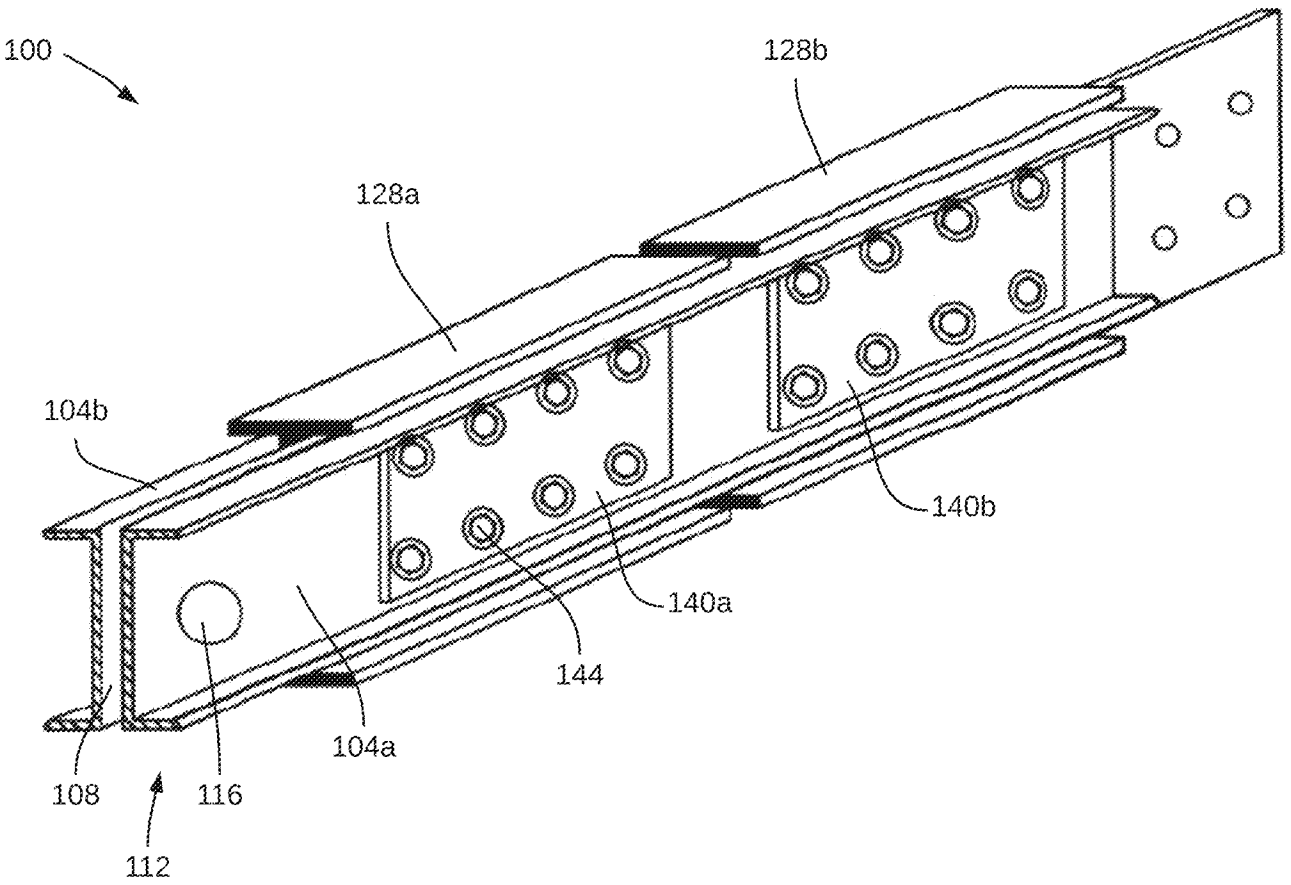
FIG. 2A illustrates a perspective view of a multi-load friction damper according to one example embodiment.
Figure 2B:
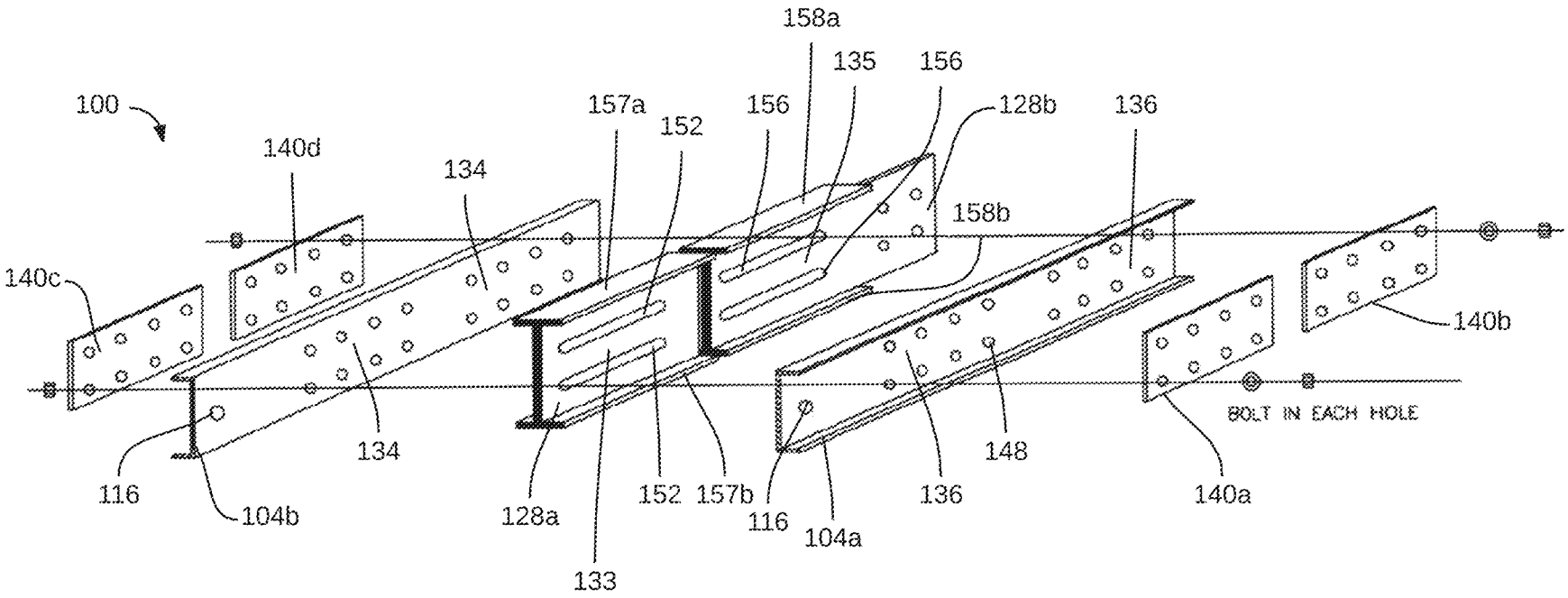
FIG. 2B illustrates an exploded view of the multi-load friction damper according to the example embodiment.
Figure 2C:
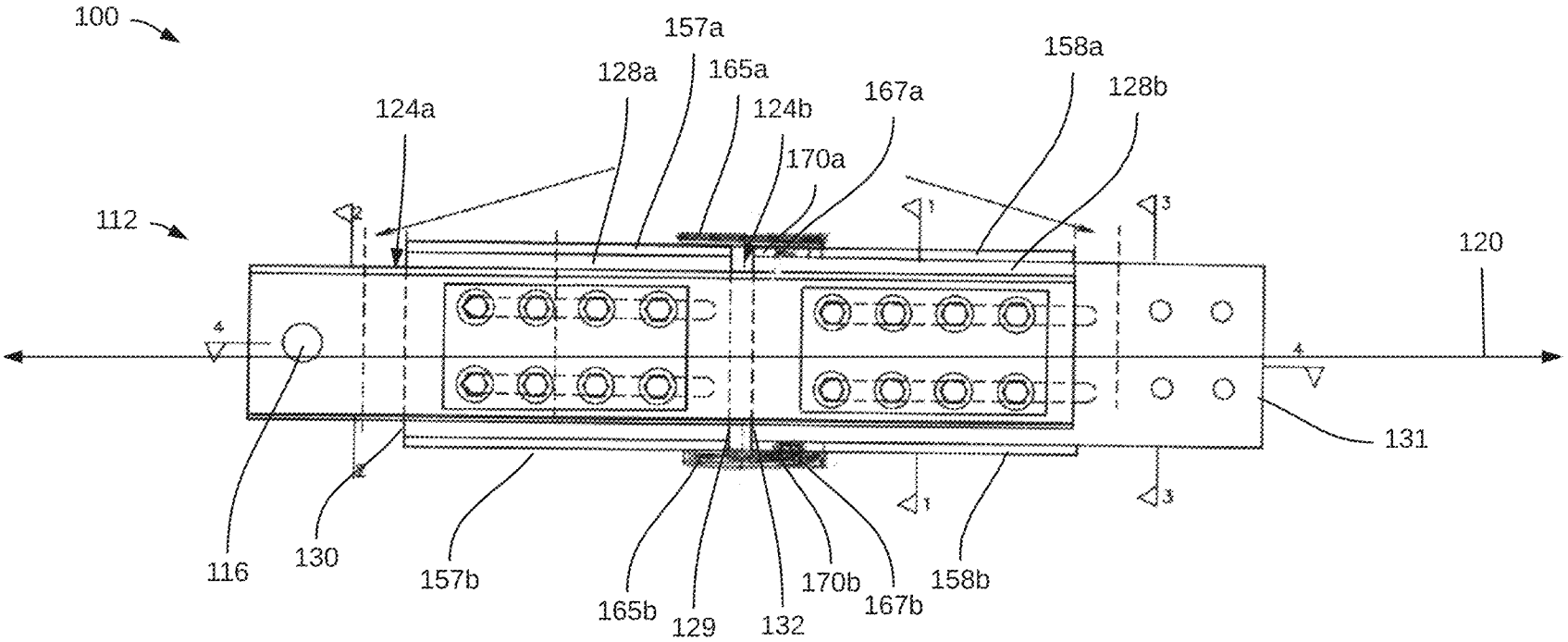
FIG. 2C illustrates a side elevation view of the multi-load friction damper according to the example embodiment.
Figure 2D:
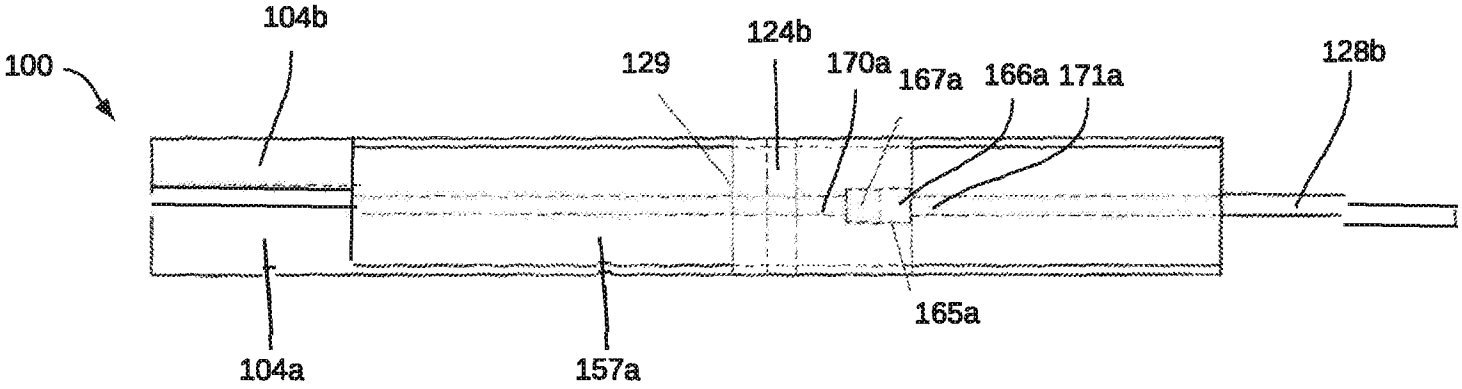
FIG. 2D illustrates a top plan view of the multi-load friction damper according to the example embodiment.
Figure 2F:
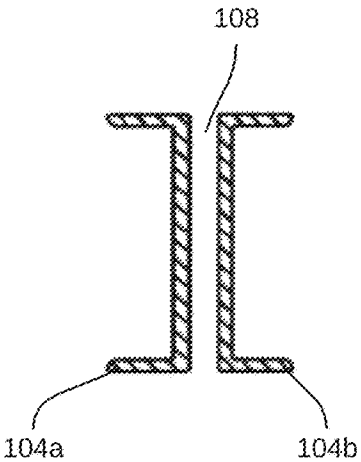
FIG. 2F illustrates a section view along the line 2-2 of FIG. 2C of the multi-load friction damper according to the example embodiment.
Figure 2I:
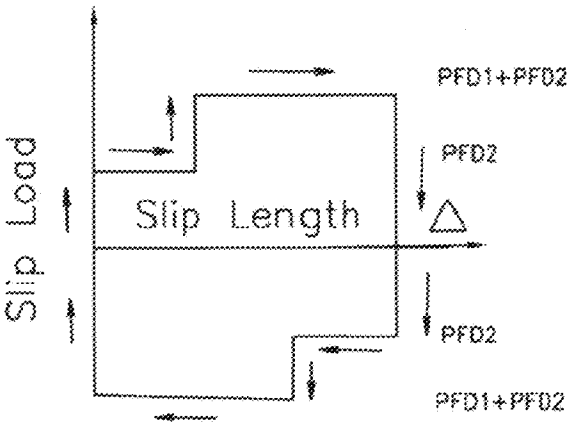
FIG. 2I illustrates a graph of a hysteresis loop showing slip load vs slip length of the multi-load friction damper according to the example embodiment.
Figure 2E:
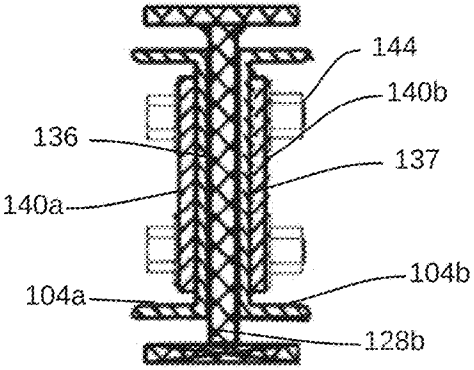
FIG. 2E illustrates a section view along the line 1-1 of FIG. 2C of the multi-load friction damper according to the example embodiment.
Figure 2G:
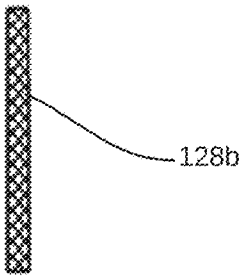
FIG. 2G illustrates a section view along the line 3-3 of FIG. 2C of the multi-load friction damper according to the example embodiment.
Figure 2H:
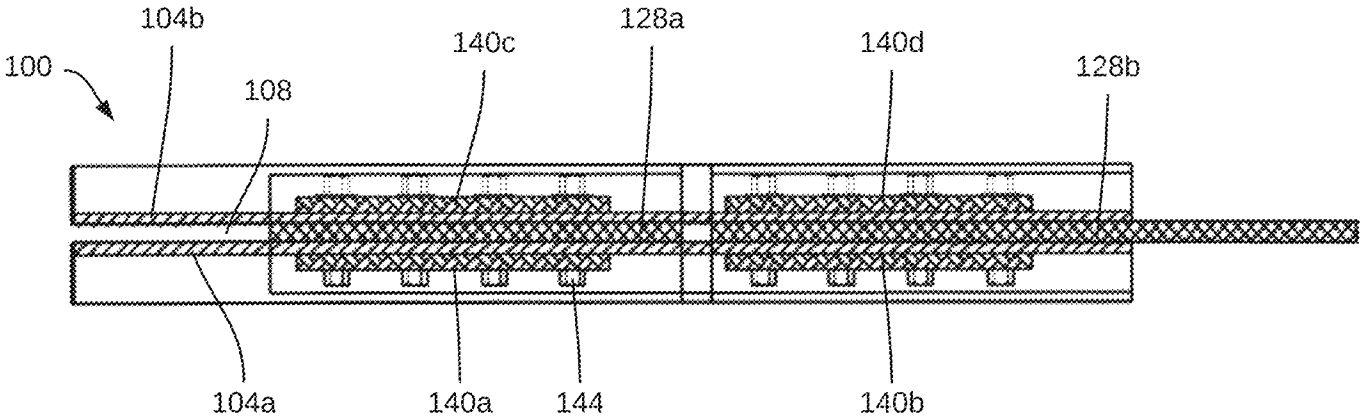
FIG. 2H illustrates a section view along the line 4-4 of FIG. 2C of the multi-load friction damper according to the example embodiment.
Figure 2J:
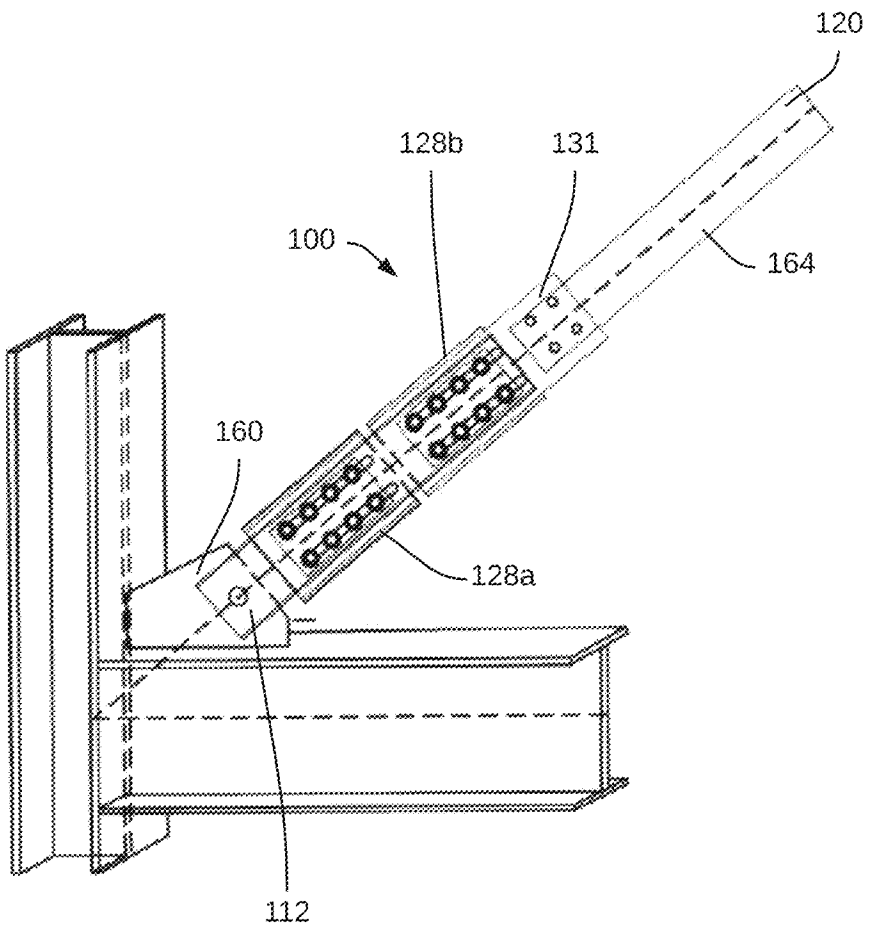
FIG. 2J illustrates a perspective view of the multi-load friction damper according to the example embodiment installed onto a building structure.
Figure 3A:
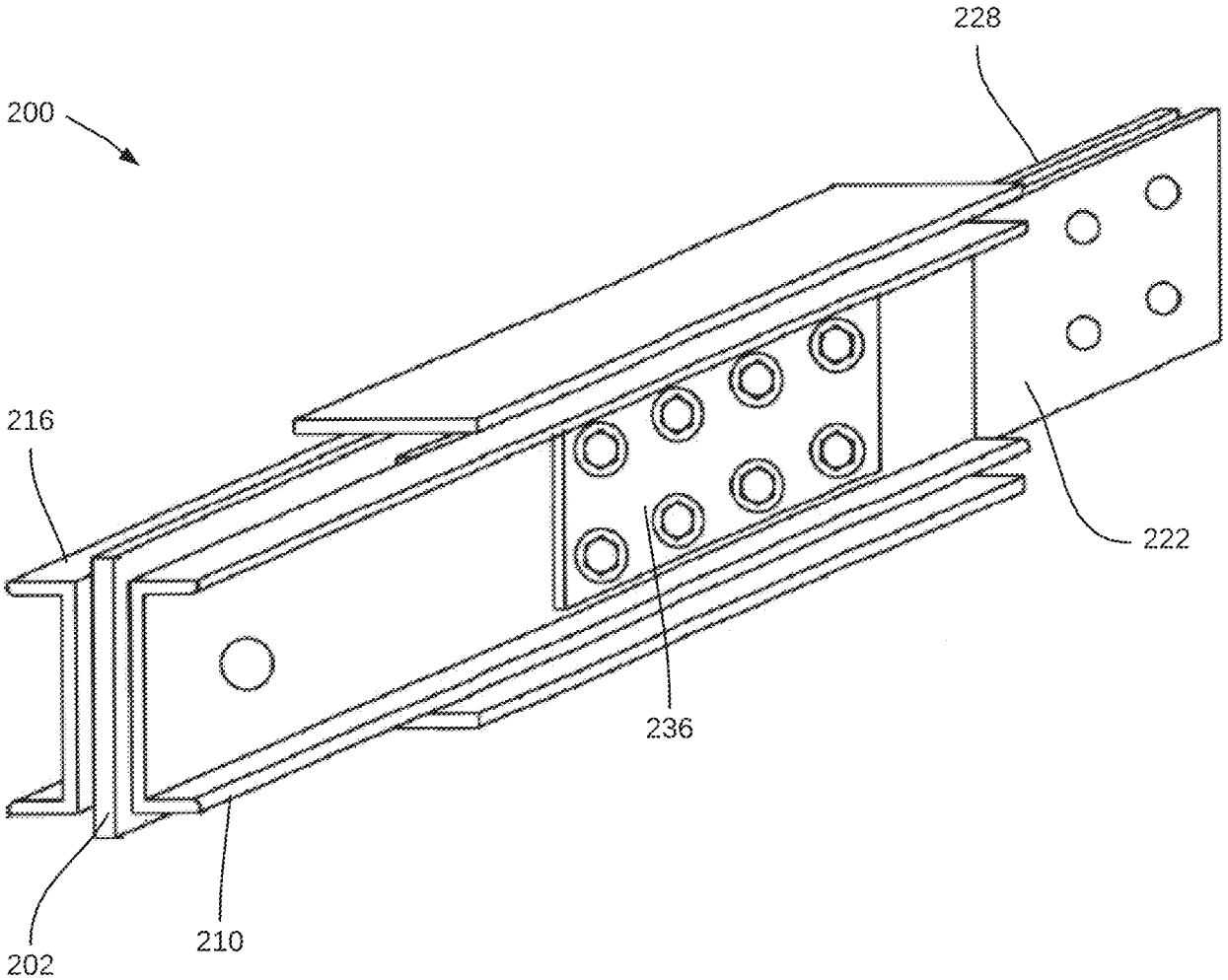
FIG. 3A illustrates a perspective view of a multi-layer friction damper according to an example embodiment.
Figure 3B:
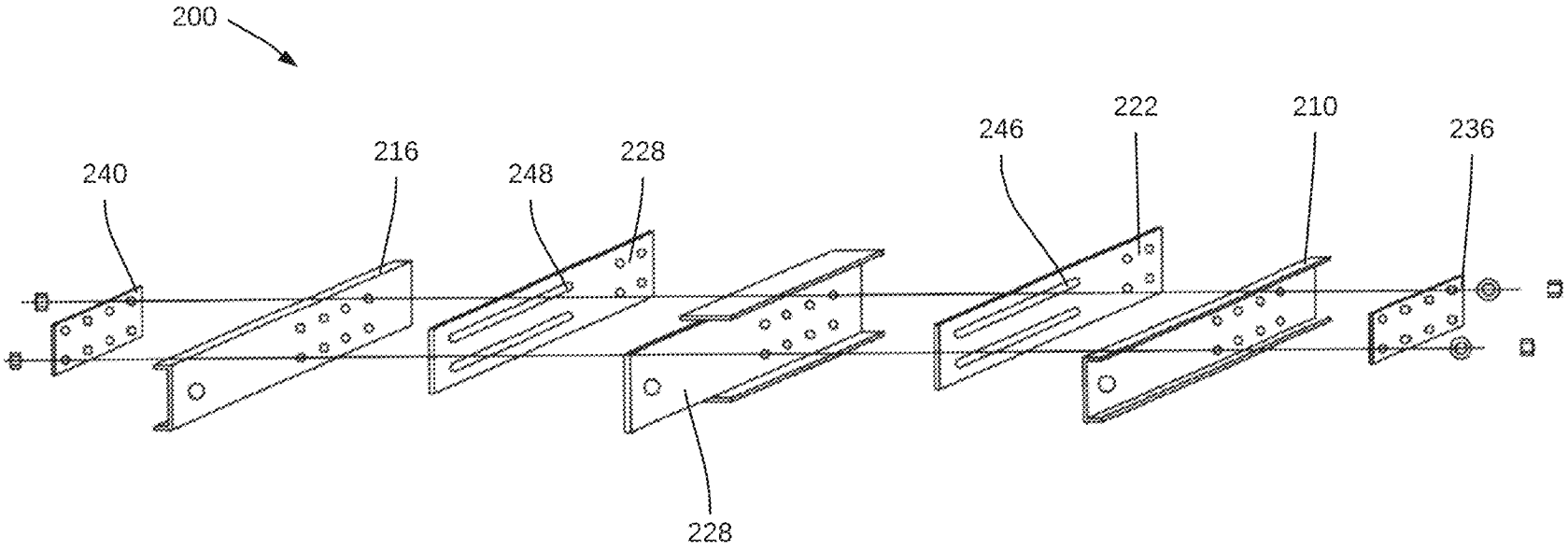
FIG. 3B illustrates an exploded view of the multi-layer friction damper according to the example embodiment.
Figure 3C:
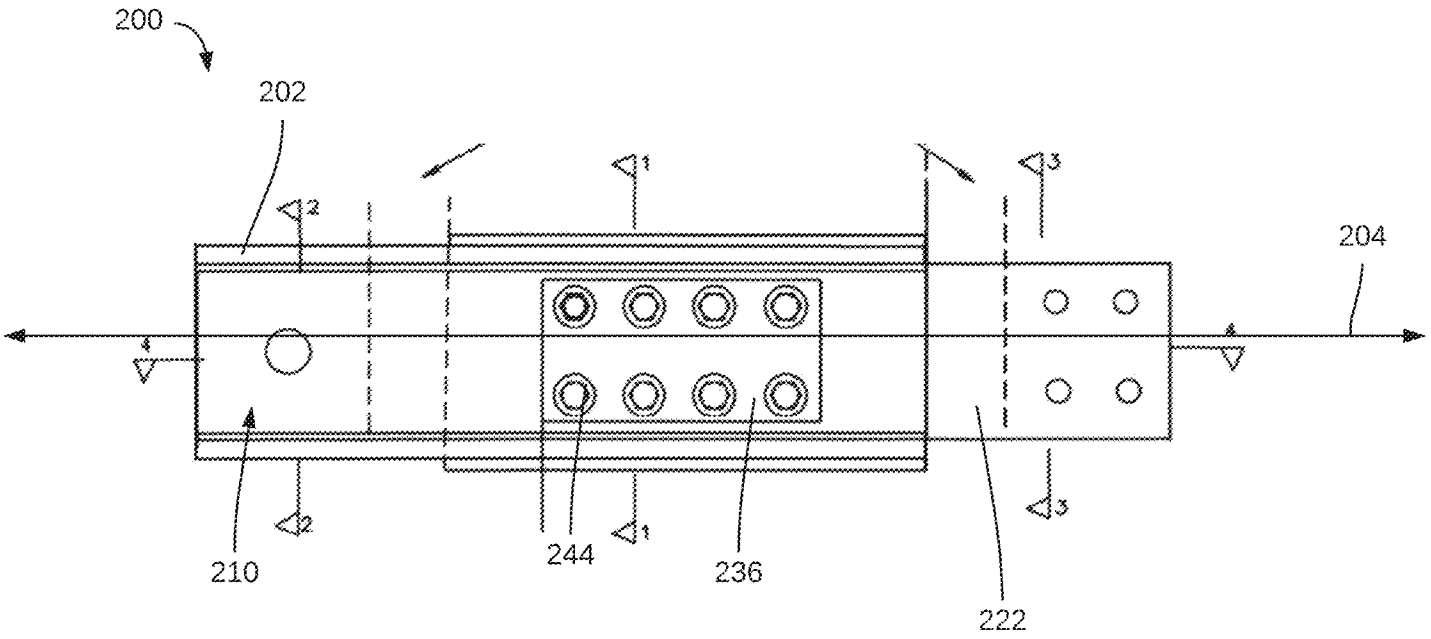
FIG. 3C illustrates a side elevation view of the multi-layer friction damper according to the example embodiment.
Figure 3D:
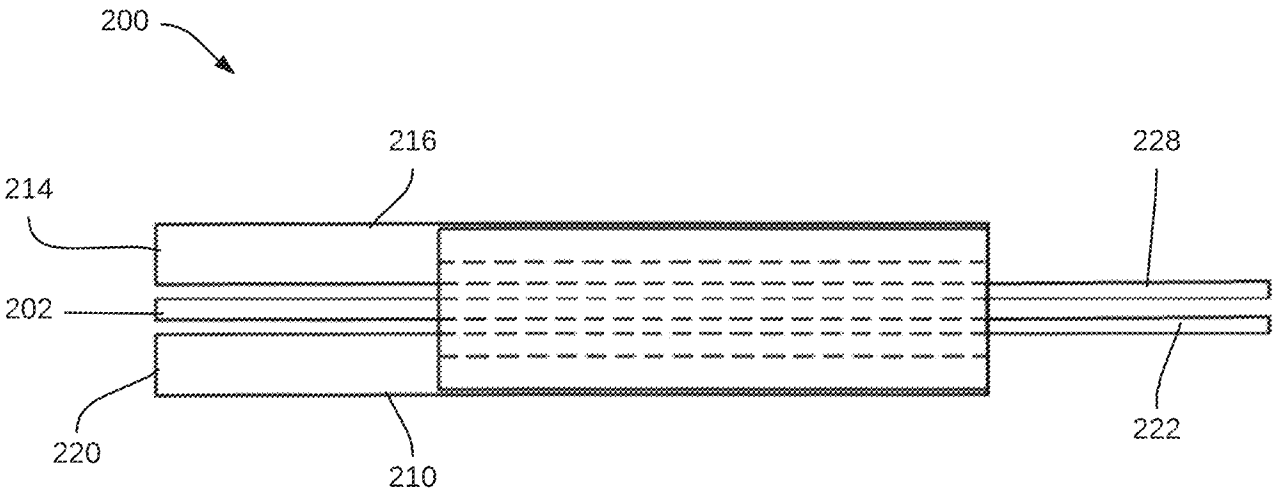
FIG. 3D illustrates a top plan view of the multi-layer friction damper according to the example embodiment.
Figure 3F:
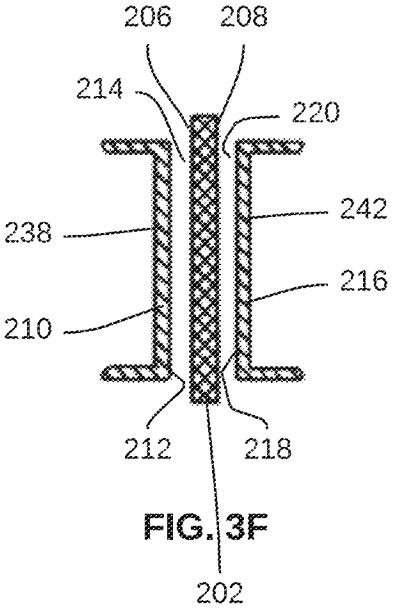
FIG. 3F illustrates a section view along the line 2-2 of FIG. 3C of the multi-layer friction damper according to the example embodiment.
Figure 3I:
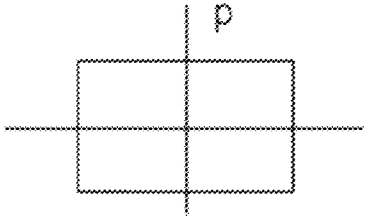
FIG. 3I illustrates a graph of a hysteresis loop showing slip load vs slip length of the multi-layer friction damper according to the example embodiment.
Figure 3E:
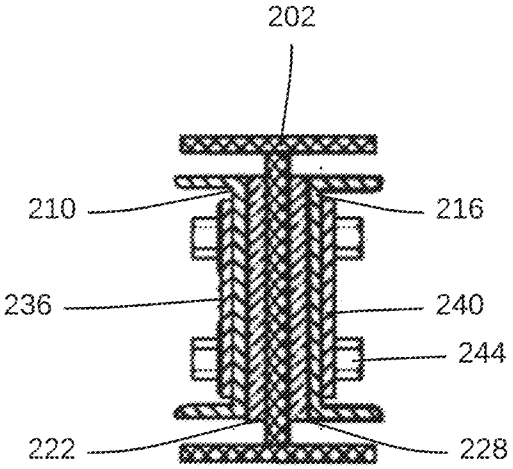
FIG. 3E illustrates a section view along the line 1-1 of FIG. 3C of the multi-layer friction damper according to the example embodiment.
Figure 3G:
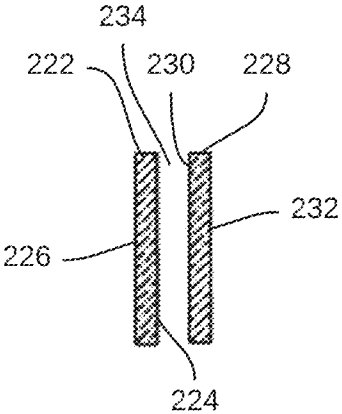
FIG. 3G illustrates a section view along the line 3-3 of FIG. 3C of the multi-layer friction damper according to the example embodiment.
Figure 3H:
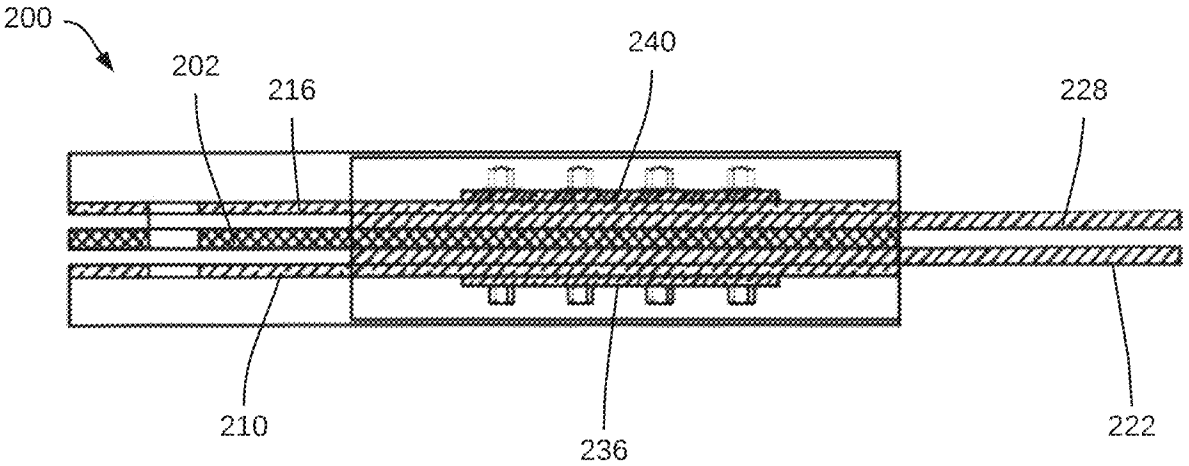
FIG. 3H illustrates a section view along the line 4-4 of FIG. 3C of the multi-layer friction damper according to the example embodiment.
Figure 3J:
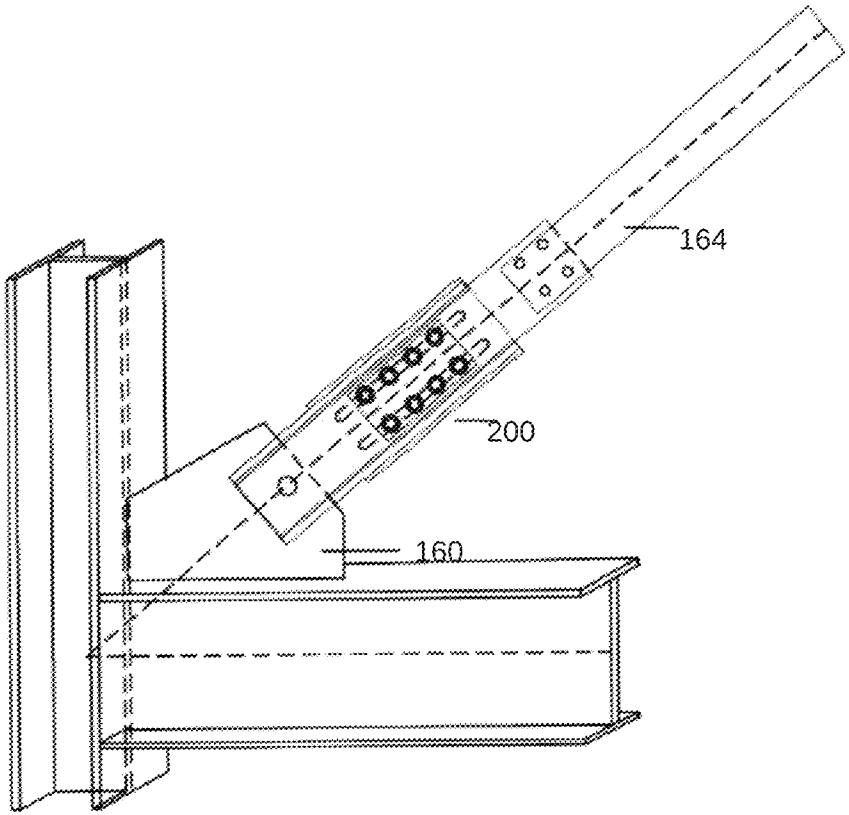
FIG. 3J illustrates a perspective view of the multi-layer friction damper according to the example embodiment installed onto a building structure.

Furthermore, while FIGS. 2J and 3J illustrate the gusset-side plate(s) being coupled to a lower location of the building structure and the brace-side plate(s) being coupled to an upper location of the building structure, in other embodiments, the gusset-side plate(s) can be coupled to the upper location of the building and the brace-side plate(s) can be coupled to the lower location of the building. It will be appreciated that the terms "brace-side" and "gusset-side" are used for ease of reference and are not intended to be limiting as to the particular building elements to which the sides of the friction damper are coupled to.

Referring now to FIGS. 2A, 2B, and 2C therein illustrated is perspective view, an exploded view, and side elevation view respectively, of a multi-load friction damper 100 according to one example embodiment. FIGS. 2D, 2E, 2F, 2G and 2H further illustrate a top plan view, section view along the line 1-1, section view along the line 2-2, section view along the line 3-3 and section view along the line 4-4, respectively, of the multi-load friction damper 100 according to the example embodiment.

The multi-load friction damper 100 includes a pair of opposed gusset-side plates 104*a*, 104*b* that are spaced apart to define a slip channel 108 therebetween (see FIG. 2F). In the illustrated example, the gusset-side plates 104*a*, 104*b* have a C-shaped cross-section, but it will be understood that the plates 104*a*, 104*b* may have other suitable cross-sectional shapes.

A proximal end region 112 of the gusset-side plates 104*a*, 104*b* are engageable with a gusset of a building structure. For example, and as illustrated, the proximal end region 112 includes openings 116 for attachment to the gusset of the building structure.

However, as described elsewhere herein, according to an alternative example embodiment, the proximal end region 112 of the gusset-side plates 104*a*, 104*b* can be configured to be engaged with a brace of the building structure.

The gusset-side plates 104*a*, 104*b* extend along and define a bracing axis 120. Accordingly, the slip channel 108 also extends along the bracing axis 120.

The cross-section at line 2-2, as illustrated in FIG. 2F correspond to non-overlapping portions 124*a* or 124*b* of the multi-load friction damper 100 and the lengths of the slip channel 108 corresponding to these non-overlapping portions 124*a*, 124*b* are unoccupied when the multi-load friction damper 1 is in its non-slip state, thereby defining a clear space within the slip channel 108.

The multi-load friction damper 100 includes a first brace-side plate 128*a* and a second brace-side plate 128*b*. The first brace-side plate 128*a* extends along and is aligned with the bracing axis 120. The first brace-side plate 128*a* is received within the slip channel 108 and is pinched between the pair of opposed gusset-side plates 104*a*, 104*b*. A first set of frictional engagements is formed between the first brace-side plate 128*a* and the opposed gusset-side plates 104*a*, 104*b*.

Outer lateral surfaces 133 of the first brace-side plate 128*a* include friction portions. Furthermore, each of the pair of opposed gusset-side plates also include inner lateral surfaces 134, which further each have friction portions. Frictional engagements are formed from contact between friction portions of the outer lateral surfaces 133 of the first brace-side plate 128*a* with the friction portions of the inner lateral surfaces 134 of the gusset-side plates 104*a*, 104*b*. The friction portions of the surfaces 133 of the first brace-side plates 128*a* and the friction portions of the inner surfaces 134 of the gusset-side plates 104*a*, 104*b* are treated to improve the frictional engagement. This set of first frictional engagements defines a first frictional force, which corresponds to the force applied along the bracing axis 120 that causes the first brace-side plate 128*a* to slip with respect to the gusset-side plates 104*a*, 104*b*. As illustrated, the first brace-side plate 128*a* has a proximal end 129 and a distal end 130.

The second brace-side plate 128*b* also extends along and is aligned with the bracing axis 120. The second brace-side plate 128*b* is also received within the slip channel 108 and is pinched between the pair of opposed gusset-side plates 104*a*, 104*b*. A second set of frictional engagements is formed between the second brace-side plate 128*b* and the opposed gusset-side plates 104*a*, 104*b*.

The second brace-side plate 128*b* has a proximal end 131 and a distal end 132. The proximal end 131 is engageable with a brace of a building structure. The distal end 132 of the second brace-side plate 128*b* faces the proximal end 129 of the first brace-side plate 128*a*.

However, as described elsewhere herein, according to an alternative example embodiment, the proximal end 131 of the second brace-side plate can be configured to be engaged with a gusset of the building structure.

According to one example embodiment, and as illustrated in FIG. 2C, the distal end 132 of the second brace-side plate 128*b* is spaced apart from the proximal end 129 of the first brace-side plate 128*a* when the two plates 128*a*, 128*b* are both in a non-slip state. This spacing defines the second non-overlapping portion 124*b*.

Outer lateral surface 135 of the second brace-side plate 128*b* also include friction portions. Frictional engagements are formed from contact between friction portions of the outer surfaces 135 of the second brace-side plate 128*b* with the friction portions inner surfaces 134 of the gusset-side plates 104*a*, 104*b*. The friction portions of the outer lateral surfaces 135 of the second brace-side plates 128*b* and the inner lateral surfaces 134 of the gusset-side plates 104*a*, 104*b* are treated to improve the frictional engagement. This set of second frictional engagements defines a second frictional force, which corresponds to the force applied along the bracing axis 120 that causes the second brace-side plate 128*b* to slip with respect to the gusset-side plates 104*a*, 104*b*.

As illustrated in FIGS. 2B and 2E, first and second clamping members 140*a*, 140*b* are disposed on the outer surface 136 of the first of the gusset-side plates 104*a*. Third and fourth clamping members 140*c*, 140*d* are disposed on the outer surface 137 of the second of the gusset-side plates 104*b*. Fasteners 144 extend through openings 148 of the gusset-side plates 104*a*, 104*b* and slotted openings 152 of the first brace-side plates 128*a* and slotted openings 156 of the second brace-side plates 128*b* to fasten the clamping members 140*a*, 140*b*, 140*c* and 140*d* together. The clamping by the fasteners apply the normal forces on the surfaces of the first and second brace-side plates 128*a*, 128*b* and gusset-side plates 104*a*, 104*b*, thereby causing the frictional engagements corresponding to the first frictional force and the second frictional force.

More particularly, the first and third clamping members 140*a*, 140*c* apply the first normal forces that causes the first frictional force of the first brace-side plates 128*a* with the gusset-side plates 104*a*, 104*b*. The second and fourth clamping members 140*b*, 140*d* apply the second normal forces that causes the second frictional force of the second brace-side plates 128*b* with the gusset-side plates 104*a*, 10*b*.

According to one example embodiment, and as best seen in FIG. 2B, each of the first and second brace-side plates 128*a*, 128*b* have lower and upper cross-plates. An upper cross-plate 157*a* of the first brace-side plate 128*a* extends transversely over an upper edge thereof. A lower cross-plate 157*b* of the first brace-side plate 128*a* extends transversely over a lower edge thereof. An upper cross-plate 158*a* of the second brace-side plate 128*b* extends transversely over an upper edge thereof. A lower cross-plate 158*b* of the second brace-side plate 128*b* extends transversely over a lower edge thereof.

As illustrated in FIG. 2C, the multi-load friction damper 100 includes at least one stopper plate extending over the gap 124*b* formed between the proximal end 129 of the first brace-side plate 128*a* and the distal end 132 of the second brace-side plate 128*b* (for clarity of illustrates, the stopper plate is omitted from FIGS. 2A, 2B and 2J). The at least one stopper plate is connected to the cross-plate of one of the first and second brace-side plates 128*a*, 128*b* and includes a stopper member that delimits the relative motions of the first and second brace-side plates 128*a*, 128*b*.

In the illustrated example, an upper stopper plate 165*a* is welded onto the upper surface of the upper cross-plate 157*a* of the first brace-side plate 128*a* and a lower stopper plate 165*b* is welded onto the lower surface of the lower cross-plate 157*b*. Each of the upper stopper plate 165*a* and the lower stopper plate 165*b* extends over the gap 124*b* and overlaps with a distal end 132 of second brace-side plate 128*b*.

A slot is formed in each of the distal end portion of the upper cross-plate 158*a* and lower cross-plate 158*b*. An upper stopper portion 167*a* extends downwardly from the upper stopper plate 165*a* into an upper slot 166*a* of the upper cross-plate 158*a* and a lower stopper portion 167*b* extends upwardly from the lower stopper plate 165*b* into a lower slot 166*b* of the upper cross-plate 158*b*.

Figure 2L:
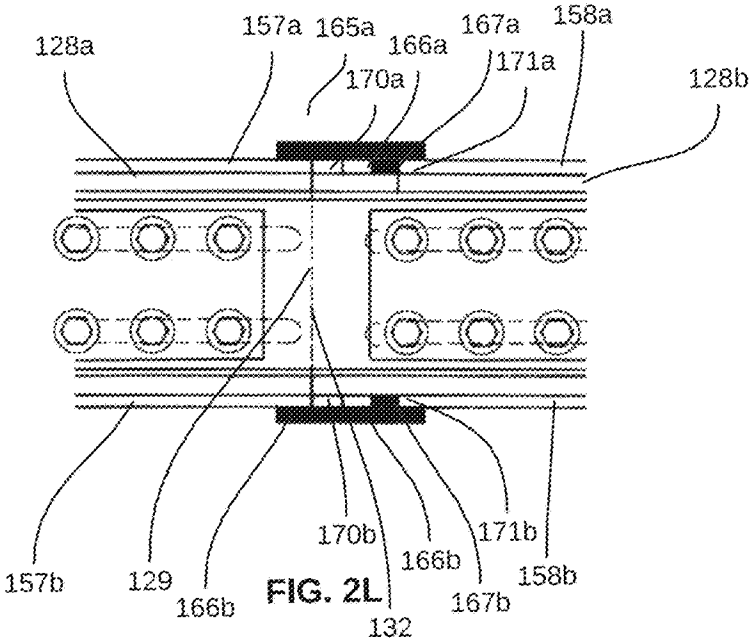
FIG. 2L illustrates a close-up view of the multi-load friction damper according to the example embodiment.
Figure 2K:
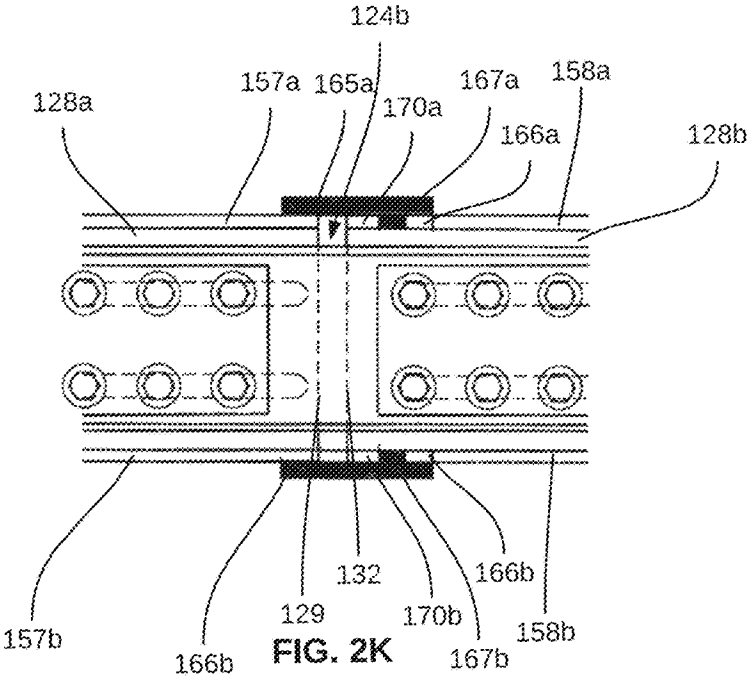
FIG. 2K illustrates a close-up view of the multi-load friction damper according to the example embodiment.

FIG. 2K illustrates a close-up view of the proximal end 129 of the first brace-side plate 128*a* and distal end 132 of the second brace-side plate 128*b* in a first relative position. The proximal end 129 and distal end 132 are spaced apart from one another to define the gap 124*b*. The upper stopper portion 167*a* abuts a front wall 170*a* of the upper slot 166*a* of the upper cross-plate 158*a* of the second brace-side plate 128*b* and the lower stopper portion 167*b* abuts a front wall 170*b* of the lower slot 166*b* of the lower cross-plate 158*b* of the second brace-side plate 128*b*.

The configuration illustrated in FIG. 2K may correspond to a state in which both the first brace-side plate 128*a* and the second brace-side plate 128*b* are in a non-slip state.

The configuration illustrated in FIG. 2K may also correspond to a state in which the second brace-side plate 128*b* is slipping away from the first brace-side plate 128*a*. The front walls 170*a* and 170*b* can abut the upper stopper 167*a* and lower stopper 167*b*, respectively, which causes the first brace-side plate 128*a* to be pulled by the second brace-side plate 128*b*.

FIG. 2L illustrates a close-up view of the proximal end 129 of the first brace-side plate 128*a* and distal end 132 of the second brace-side plate 128*b* in a second relative position. As the second brace-side plates 128*b* slips towards the gusset, the upper stopper portion 167*a* abuts a rear wall 171*a* of the upper slot 166*a* of the upper cross-plate 158*a* of the second brace-side plate 128*b* and the lower stopper portion 167*b* abuts a rear wall 171*b* of the lower slot 166*b* of the lower cross-plate 158*b* of the second brace-side plate 128*b*. Therefore, the slots 166*a*, 166*b* and the stopper portions 167*a*, 167*b* delimit the range of the relative movements of the first and second brace-side plates 128*a*, 128*b*.

The configuration illustrated in FIG. 2L may correspond to a state in which the first brace-side plate 128*a* had slipped and abutted the second brace-side plate 128*b*, while the second brace-side plate 128*b* is still in a non-slip state.

The configuration illustrated in FIG. 2L may also corresponds to a state in which both the first brace-side plate 128*a* and the second brace-side plate 128*b* have entered a slipping state and are slipping the direction of the distal end 130 of the first brace-side plate.

FIG. 2J is a perspective view of the multi-load friction damper 100 being installed on a building structure. It will be appreciated that the proximal end region 112 of the gusset-side plates 104*a*, 104*b* are connected to a gusset 160 of the building structure. The proximal end 131 of the second brace-side plates 128*b* is connected to a brace 164.

The multi-load friction damper 100 is in a non-slip state when the force applied along the bracing axis 120 does not exceed either the first frictional force or the second frictional force. In this non-slip state, as illustrated in FIGS. 2A and 2C, the first set of frictional engagements and the second set of frictional engagements are both maintained. The first and second frictional forces are both sufficiently high to maintain the frictional engagement under normal forces along the bracing axis 120 (compression or tension) with the building structure (i.e. when an earthquake is not occurring).

The multi-load friction damper 100 has two slipping states. The multi-load friction damper 100 enters a first slipping state when the force applied along the bracing axis 120 is sufficiently high to cause one of the brace-side plates 128*a* or 128*b* to begin slipping. Furthermore, in this first slipping state, the frictional engagement of the other of the brace-side plates is still maintained. It will be appreciated that in this first slipping state, only one of the brace-side plates is slipping.

The multi-load friction damper 100 enters a second slipping state when the force applied along the bracing axis 120 is sufficiently high to cause both of the brace-side plates 128*a*, 128*b* to slip relative to the gusset-side plates 104*a*, 104*b*. That is the force applied along the bracing axis 120 exceeds both the first frictional force and the second frictional force of the first and second frictional engagements.

According to one example embodiment, the first frictional force is greater than the second frictional force. Accordingly, a first load applied on the multi-load friction damper 100 along the bracing axis 120 that is greater than the second frictional force but less than the first frictional force causes only the second brace-side plate 128*b* to enter a first slipping state. In this first slipping state, the second brace-side plate 128*b* is slipping towards the first brace-side plate 128*a* and the first brace-side plate 128*a* is not slipping. This slipping of the brace-side plate 128*b* continues until the distal end 132 of the second brace-side plate 128*b* abuts the proximal end 129 of the first brace-side plate 128*a*.

A second load applied on the multi-load friction damper 100 along the bracing axis 120 that is greater than the first frictional force causes both the first brace-side plate and the second brace-side plate to enter a second slipping state.

In this second slipping state, the second brace-side plate 128*b* and the first brace-side plate 128*a* are both slipping in a direction of the distal end 130 of the first brace-side plate 128*a*. It will be appreciated that this direction of slipping corresponds to a direction towards the gusset 160 to which the gusset-side plates 104*a*, 104*b* are attached.

Figure 2M:
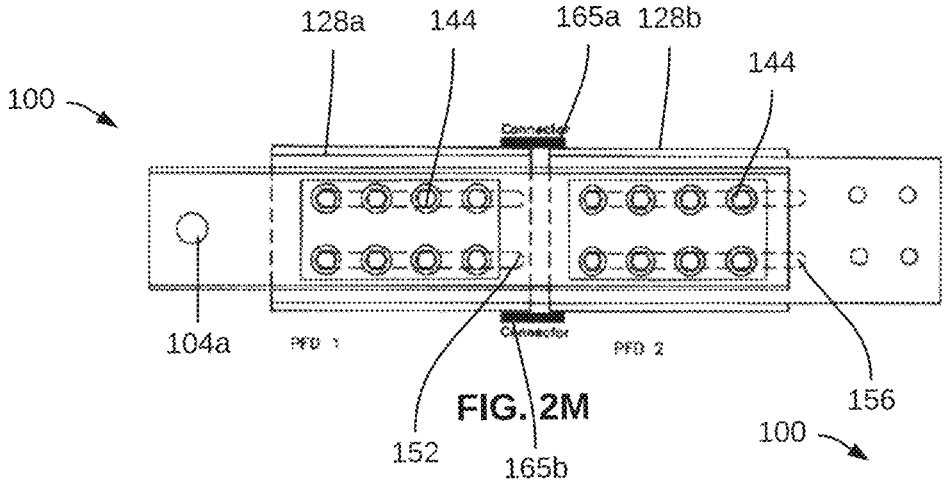
FIG. 2M illustrates a side elevation view of the multi-load friction damper according to the example embodiment in a first state.

Referring now to FIGS. 2M to 2R, therein illustrated are side elevation views of the multi-load friction damper 100 in various states of non-slipping and slipping. FIG. 2M shows the multi-load friction damper 100 in first state corresponding to a non-slip state. As illustrated, both the set of fasteners 144 for the first brace-side plate 128*a* and the second brace-side plate 128*b* are located at respective distal ends (i.e. gusset-side) of the slotted openings 152 and 156.

Figure 2N:
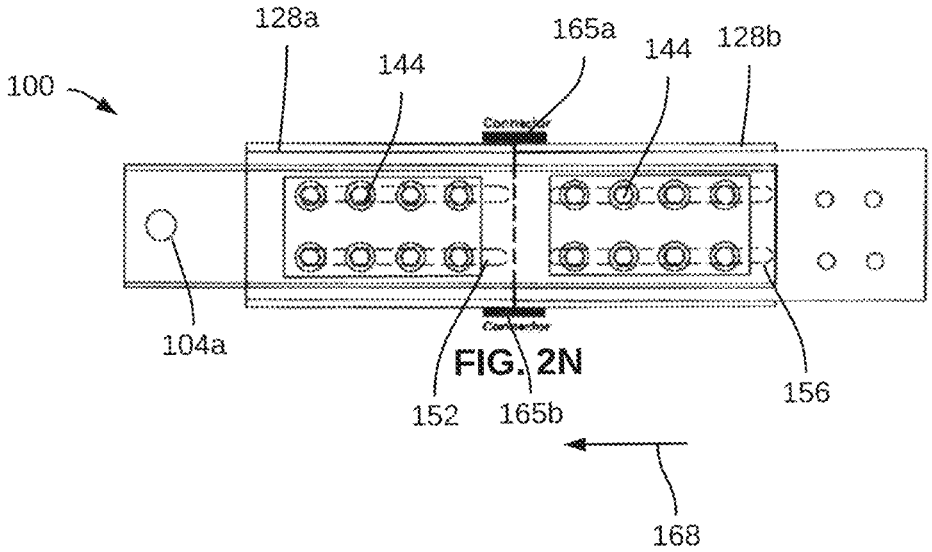
FIG. 2N illustrates a side elevation view of the multi-load friction damper according to the example embodiment in a second state.

FIG. 2N shows the multi-load friction damper 100 in a second state corresponding to the first slipping state. As illustrated, the second brace-side plate 128*b* is slipping relative to the gusset-side plates 104*a*, 104*b*, as indicated by arrow 168. The second brace-side plate 128*b* is also slipping towards the first brace-side plate 128*a*, this latter plate 128*a* being stationary relative to the gusset-side plates 104*a*, 104*b*. In the illustrated example, the second brace-side plate 128*b* has been sufficiently displaced such that its distal end 132 abuts the proximal end 129 of the first brace-side plate 128*a*. As the second brace-side plates 128*b* slips towards the gusset, the upper stopper portion 167*a* abuts a rear wall 171*a* of the upper slot 166*a* of the upper cross-plate 158*a* of the second brace-side plate 128*b* and the lower stopper portion 167*b* abuts a rear wall 171*b* of the lower slot 166*b* of the lower cross-plate 158*b* of the second brace-side plate 128*b*.

Figure 2O:
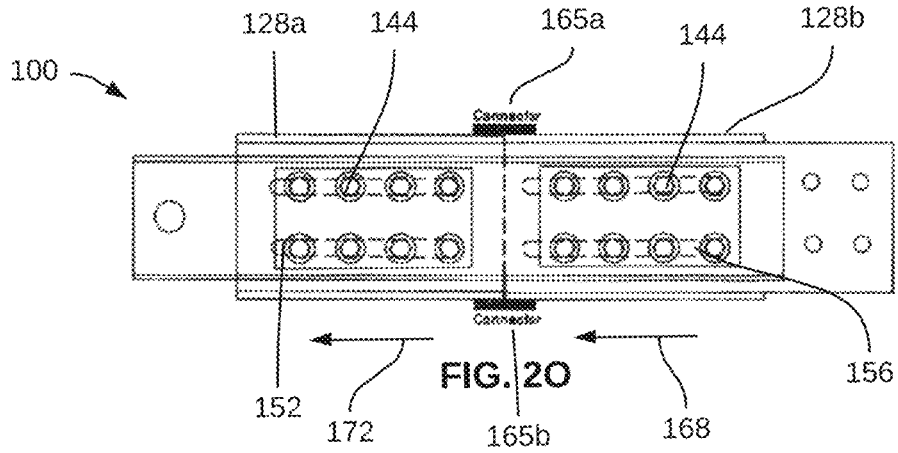
FIG. 2O illustrates a side elevation view of the multi-load friction damper according to the example embodiment in a third state.

FIG. 2O shows the multi-load friction damper 100 in a third state corresponding to the second slipping state. As illustrated, the second brace-side plate 128*b* and the first brace-side plate 128*a* are both slipping relative to the gusset-side plates 104*a*, 104*b*, as indicated by arrows 168, 172. The first and second brace-side plates 128*a*, 128*b* are slipping towards the gusset-side of the multi-load friction damper.

Figure 2P:
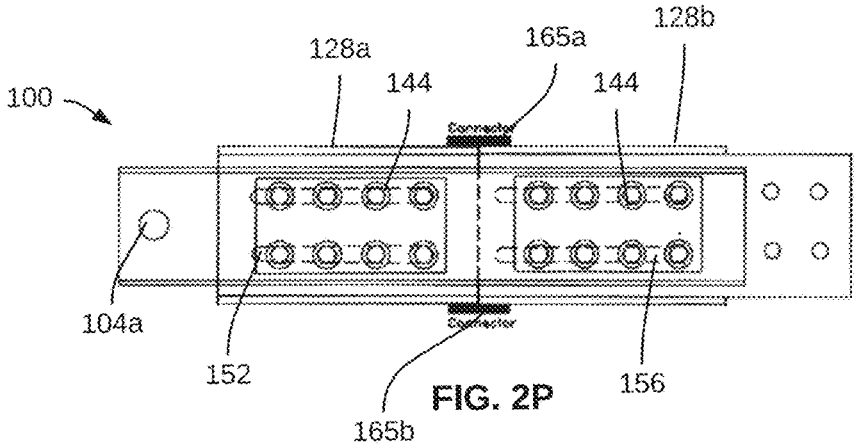
FIG. 2P illustrates a side elevation view of the multi-load friction damper according to the example embodiment in a fourth state.

FIG. 2P shows the multi-load friction damper 100 in a fourth state corresponding to the second non-slip state in which the movement of the first and second brace-side plates 128*a*, 128*b* are delimited by proximal ends (i.e. brace side) of the first and second slotted openings 152, 156.

Figure 2Q:
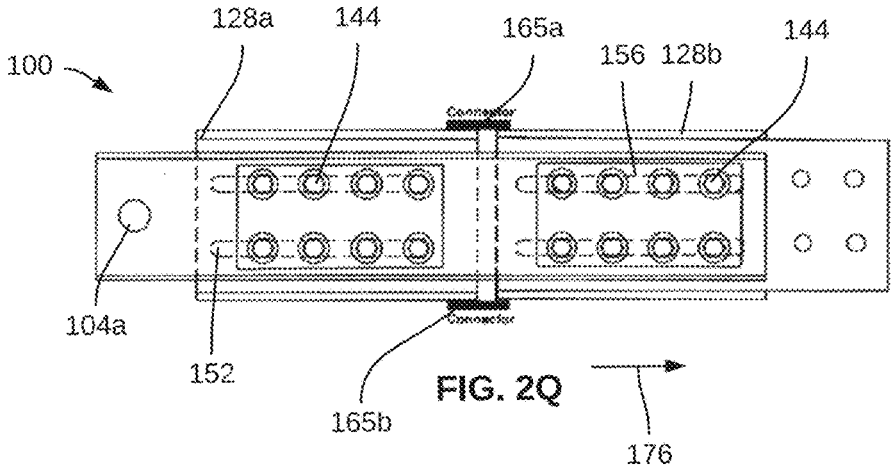
FIG. 2Q illustrates a side elevation view of the multi-load friction damper according to the example embodiment in a fifth state.

FIG. 2Q shows the multi-load friction damper 100 in a fifth state corresponding to a third slipping state. This third slipping state is caused by a force applied on the multi-load friction damper 100 along the bracing axis in a direction toward the brace. This force is sufficient to cause the second brace-side plate 128*b* to slip but the first frictional engagement of the first brace-side plate 128*a* is maintained. As illustrated, the second brace-side plate 128*b* is being displaced towards its proximal end 131, as indicated by arrow 176. In the illustrated example, the second brace-side plate 128*b* has been displaced sufficiently such that the gap 124*b* is formed again between the proximal end 129 of the first brace-side plate 128*a* and the distal end 132 of the second brace-side plate 128*b*.

Figure 2R:
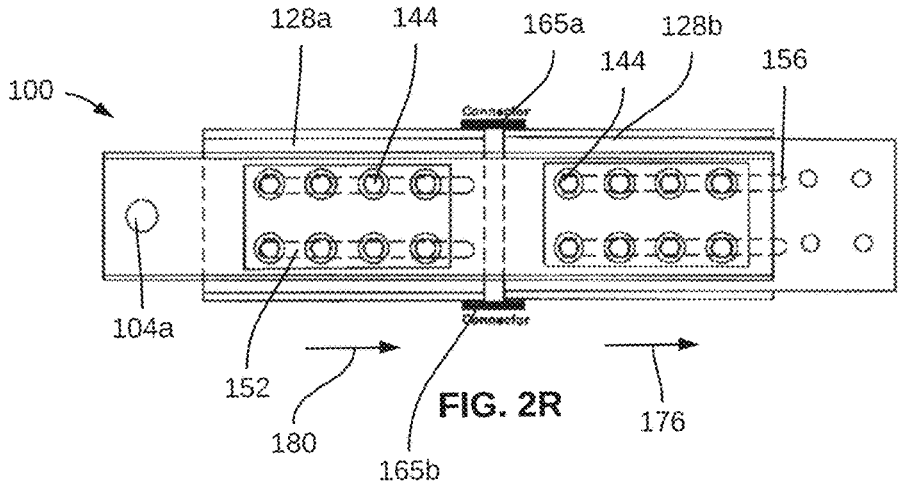
FIG. 2R illustrates a side elevation view of the multi-load friction damper according to the example embodiment in a sixth state.

FIG. 2R shows the multi-load friction damper 100 in a sixth state corresponding to a fourth slipping state. This fourth slipping state is caused by a force applied on the multi-load friction damper 100 along the bracing axis 120 in a direction toward the brace that is sufficiently high to cause both the first and second brace-side plates 128*a*, 128*b* to slip. As illustrated, both the first and second brace-side plates 128*a*, 128*b* are being displaced towards the brace side relative to the gusset-side plates 104*a*, 104*b*, as indicated by arrows 176 and 180. The front walls 170*a* and 170*b* can abut the upper stopper 167*a* and lower stopper 167*b*, respectively, which causes the first brace-side plate 128*a* to be pulled by the second brace-side plate 128*b*. The first and second brace-side plates 128*a*, 128*b* can be displaced in this direction until their respective fasteners 144 reach the proximal ends of the slotted openings 152, 156. It will be appreciated that the fasteners 144 reaching the proximal ends corresponds to a return to the first non-slip state, as illustrated in FIG. 2K.

It will be appreciated that the ranges of displacement of the brace-side plates 128*a*, 128*b* relative to the gusset-side plates 104*a*, 104*b* are defined by the lengths of their respective slotted openings 152, 156.

Referring back to FIG. 2I, therein illustrated is a hysteresis loop showing the slip load relative to the slip length. It will be appreciated that when the slip load (i.e. force along the bracing axis 120) is above a first threshold, there is partial slipping along a first range of slip length, which corresponds to the first slipping state described hereinabove. When the slip load exceeds a higher second threshold, both brace-side plates 128*a*, 128*b* being slipping along a second range of slip length.

It was observed that the multi-load friction damper 100 advantageously provides for some conversion of seismic energy applied on the bracing axis 120 at a lower level of force, corresponding a force causing only one of the brace-side plates to be slipping. A higher level of conversion of seismic energy then occurs when a higher level of force, corresponding to a force causing both the brace-side plates to be slipping.

It was further observed that in comparison to the prior art friction damper 1 described herein, the multi-load friction damper 100 can improve integrity of the building structure in that it provides for conversion of lower levels of seismic energy (ex: in the case of earthquakes of lower magnitude)), which reduces the energy that needs to be absorbed by the remainder of the building structure (ex: struts and beams of the building). It can then provide conversion of higher levels of seismic energy (ex: in the case of earthquakes of higher magnitude), further reducing the energy that needs to be absorbed by the remainder of the building structure.

It was further observed that the multi-load friction damper 100 can also be effective in reducing the physical deformation of the building structure when subjected to a seismic force. The slipping distance of the first and second brace-side plates 128*a*, 128*b* can be less than the prior art friction damper. Accordingly, the gusset and brace of the building structure to which the multi-load friction damper 100 is coupled also physically shifts by a lesser distance relative to one another.

It was further observed that in comparison to the prior art friction damper 1, the multi-load friction damper 100 can absorb/convert a greater overall amount of seismic energy, as measured by the total area within the hysteresis loop.

Referring now to FIGS. 3A, 3B, and 3C, therein illustrated is a perspective view, an exploded view, and side elevation view respectively, of a multi-layer friction damper 200 according to one example embodiment. FIGS. 3D, 3E, 3F, 3G and 3H further illustrate a top plan view, section view along the line 1-1, section view along the line 2-2, section view along the line 3-3 and section view along the line 4-4, respectively of the multi-layer friction damper 200 according to the example embodiment.

The multi-layer friction damper 200 includes a central gusset-side plate 202, extending along and defining a bracing axis 204. The central gusset-side plate 202 has a first friction surface 206 and a second friction surface 208.

The multi-layer friction damper 200 further includes a first outer gusset-side plate 210 that extends along the bracing axis 204. The first outer gusset-side plate 210 has an inner friction surface 212 that opposes the first friction surface 206 of the central gusset-side plate 202. The inner friction surface 212 and the first friction surface 206 are spaced apart and define a first slip channel 214 therebetween.

The multi-layer friction damper 200 also includes a second outer gusset-side plate 216 that extends along the bracing axis 204. The second outer gusset-side plate 216 has an inner friction surface 218 that opposes the second friction surface 208 of the central gusset-side plate 202. The inner friction surface 218 and the second friction surface 208 are spaced apart and define a second slip channel 220 therebetween.

The central gusset-side plate 202, first outer gusset-side plate 210 and second outer gusset-side plates 216 are engageable with a gusset of a building structure. Each of the plates 202, 210 and 216 have an opening at proximal ends thereof for attachment to a gusset.

However, as described elsewhere herein, according to an alternative example embodiment, the gusset-side plate 202, first outer gusset-side plate 210 and second outer gusset-side plates 216 can be configured to engage with a brace of the building structure.

The multi-layer friction damper 200 also includes a first brace-side plate 222 extending along the bracing axis 204. The first brace-side plate 222 has an inner surface 224 and an outer surface 226. As best seen in FIG. 3E, the first brace-side plate 222 is received within the first slip channel 214. When so received, the inner surface 224 of the first brace-side plate forms a first frictional engagement with the first friction surface 206 of the central gusset-side plate 202. The outer surface 226 of the first brace-side plate 222 forms a second frictional engagement with the inner friction surface 212 of the first outer gusset-side plate 210.

The multi-layer friction damper 200 further includes a second brace-side plate 228 extending along the bracing axis 204. The second brace-side plate 228 has an inner surface 230 and an outer surface 232. The second brace-side plate 228 is spaced apart from the first brace-side plate 222 to define a third slip channel 234 therebetween. The brace-side plates 222, 228 are engageable with a brace of the building structure.

However, as described elsewhere herein, according to an alternative example embodiment, the first and second brace-side plates 222, 228 can be configured to engage with a gusset of the building structure.

As best seen in FIG. 3E, the second brace-side plate 228 is received within the second slip channel 220 and the central gusset plate 202 is received within the third slip channel 234. When so received, the inner surface 230 of the second brace-side plate forms a third frictional engagement with the second friction surface 232 of the central gusset-side plate 202. The outer surface 232 of the first brace-side plate 228 forms a fourth frictional engagement with the inner friction surface 218 of the second outer gusset-side plate 216. The surfaces of the central gusset-side plate 202, outer gusset-side plates 210, 216 and brace-side plates may be treated to improve the various frictional engagements.

As illustrated in FIGS. 3B and 3E, a first clamping member 236 is disposed on an outer surface 238 of the first outer gusset-side plate 210. A second clamping member 240 is disposed on an outer surface 242 of the second outer gusset-side plate 216. Fasteners 244 extend through openings of the central gusset-side plate 202, first and second outer gusset-side plates 210, 216 and slotted openings 246, 248 of the brace-side plates 222, 228 to fasten the clamping members 236, 240 together. The clamping by the fasteners apply the normal forces on the central gusset-side plate 202, first and second outer gusset-side plates 210, 216 and brace-side plates 222, 228, thereby causing the first, second, third and fourth frictional engagements.

The first, second, third and fourth frictional engagements define a combined frictional force of the multi-layer friction damper 200.

In a non-slip state of the multi-layer friction damper 200, the first, second, third and fourth frictional engagements are maintained. The combined force of the four frictional engagements is sufficiently high to maintain the frictional engagements under seismic forces applied along the bracing axis 204 (compression or tension) within the building structure (i.e. when an earthquake is not occurring).

When a seismic force (compression or tension from an earthquake) applied along the bracing axis 204 is greater than the combined frictional force, the brace-side frictional plates 222, 228 and the gusset-side plates 202, 210, 216 slip relative to one another. It will be understood that slipping of the first brace-side plate 222, second brace-side plate 228 and central gusset-side plate 202 occur together. This slipping converts the seismic energy into a friction heat.

FIG. 3J is a perspective view of the multi-layer friction damper 200 being installed on a building structure. It will be appreciated that the proximal end region of the central gusset-side plate 202, first outer gusset-side plate 210 and second outer gusset-side plate 216 are connected to a gusset 160 of the building structure. The proximal ends of the first and second brace-side plates 222, 228 are connected to a brace 164.

While the example multi-layer friction damper 200 described herein with reference to FIGS. 3A to 3J has a single central gusset-side plate 202 and a pair of brace-side plates 222, 228, it will be understood that the multi-layer friction damper may have even more plates between the first and second outer gusset-side plates. It will be appreciated that use of additional plates forms more frictional engagements, which may further increase the combined frictional force of the multi-layer friction damper.

According to such embodiments, the multi-layer friction damper includes a set of one or more inner gusset-side plates that extend along, and define, a bracing axis. Within this set, there is a first outermost friction surface and a second outermost friction surface. A first outer gusset-side plate also extends along the bracing axis and has an inner friction surface that opposes the first outermost friction surface of the set of inner gusset-side plates, and a first slip channel is defined therebetween.

A second outer gusset-side plate also extends along the bracing axis and has an inner friction surface that opposes the second outermost friction surface of the set of inner gusset-side plates, and a second slip channel is defined therebetween.

The multi-layer friction damper further includes a set of a plurality of brace-side plates extending along the bracing axis. The set has a first outermost brace-side plate and a second outermost brace-side plate. A pair of adjacent brace-side plates of this set are spaced apart and defines a third slip channel. One of the set of inner gusset-side plates is received within the third slip channel and is pinched between the pair of adjacent brace-side plates. Other inner gusset-side plates may be received within other slip channels between other pairs of adjacent brace-side plates. Furthermore, a first outermost brace-side plate is received within the first slip channel and a second outermost brace-side plate is received within the second slip channel. Each receiving of a plate within a slip channel forms two frictional engagements from contact of the surfaces of that received plate with surfaces of plates defining the slip channel.

Advantageously, it was observed that providing the central gusset-side plate 202 and parallelly aligned brace-side plates 222, 228 to form four frictional engagements achieved a sufficiently high combined frictional force while permitting shortening the overall length of the multi-layer friction damper 200. In particular, the multi-layer friction damper 200 can be significantly shorter than the prior art friction damper 1 while achieving a substantially similar or greater frictional force. It was further observed that the multi-layer friction damper 200 is particularly useful where the bracing distance (between two adjacent structs and/or two adjacent beams) is short. Additionally, or alternatively, the multi-layer friction damper 200 is useful where an aesthetically pleasing appearance of the building structure is desirable and it is desirable that the multi-layer friction damper 200 is not visually apparent within the building structure.

In one variant, the multi-layer friction damper 200 can have a significantly greater width in a direction transverse to the bracing axis 204. This width may be significantly greater than the typical width of the prior art friction damper. It will be appreciated that the greater width further increases the frictional force of the multi-layer friction damper 200 and the amount of seismic that it can convert. To accommodate the greater width, 3 or more rows of fasteners 244 and slotted openings 246, 248 can be provided.

Figure 4A:
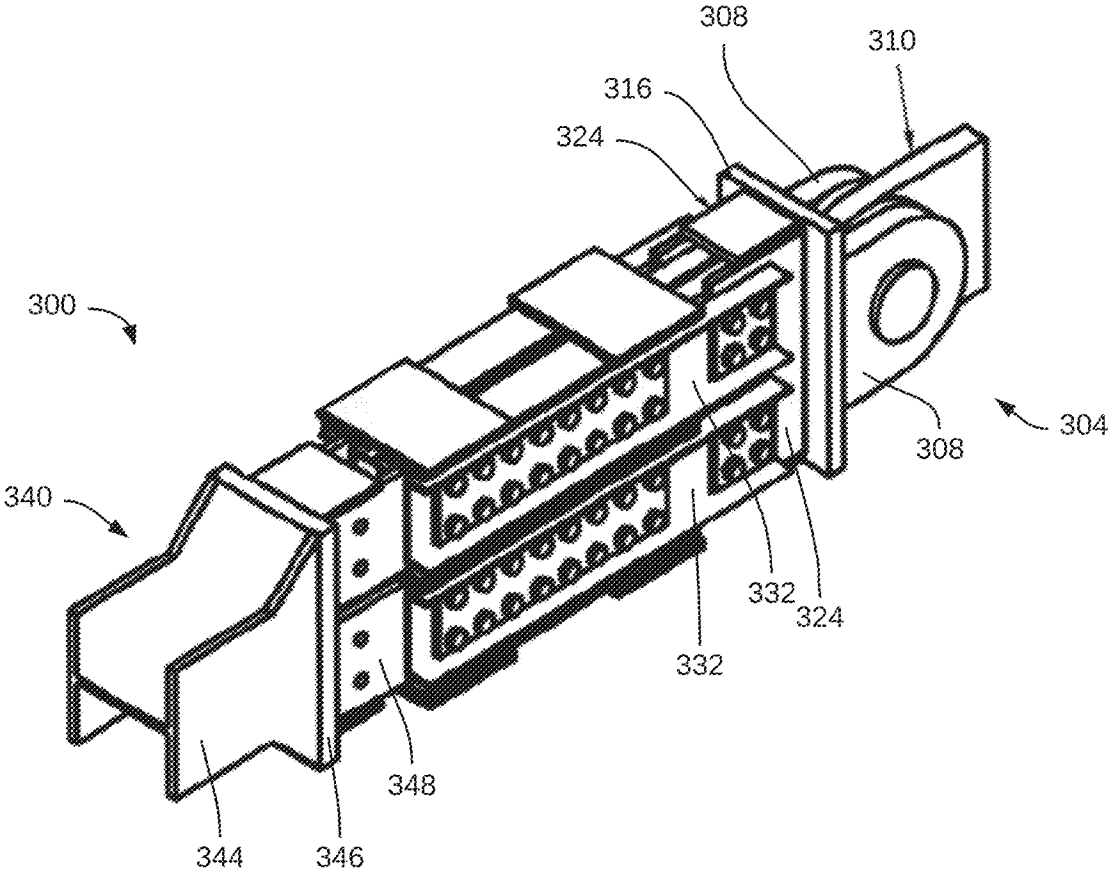
FIG. 4A illustrates a perspective view of a multi-damper assembly according to an example embodiment.
Figure 4B:
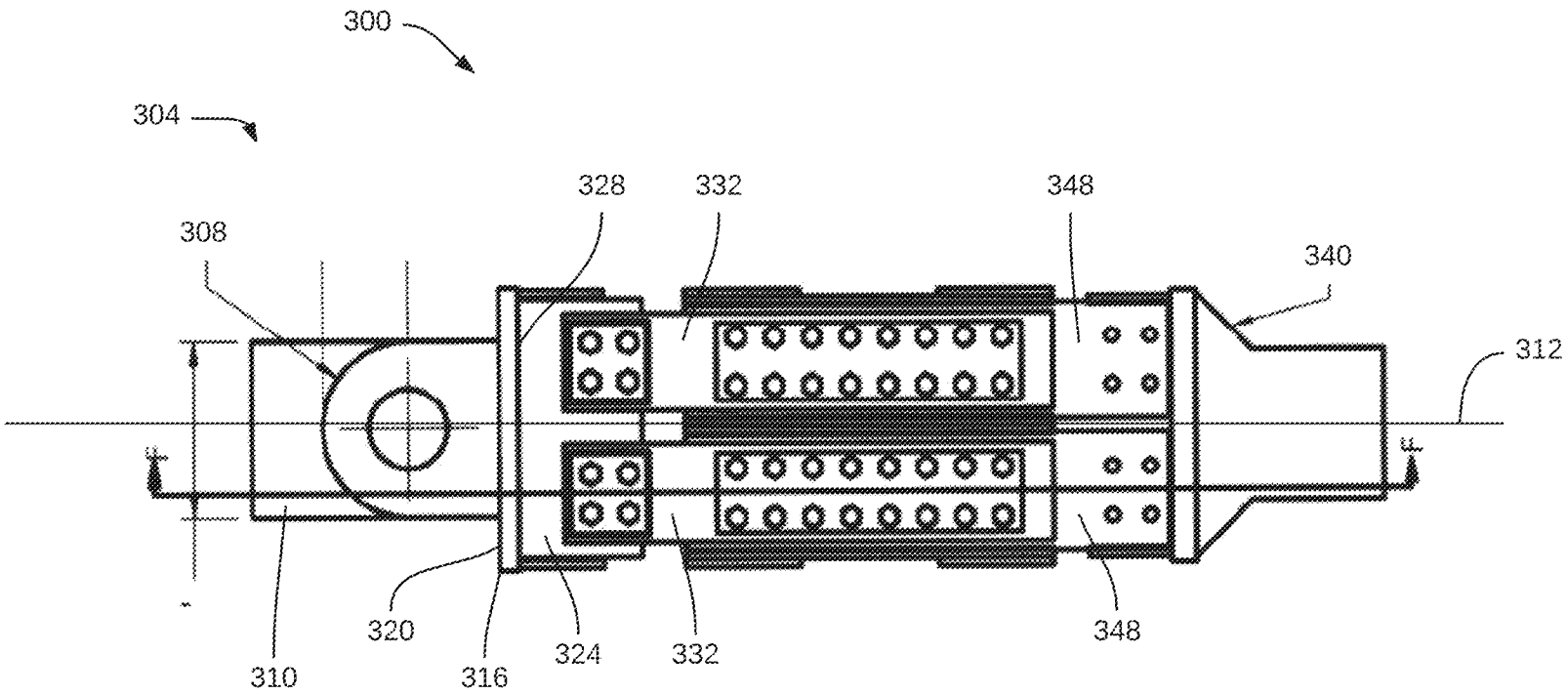
FIG. 4B illustrates a side elevation view of the multi-damper assembly according to the example embodiment.
Figure 4C:
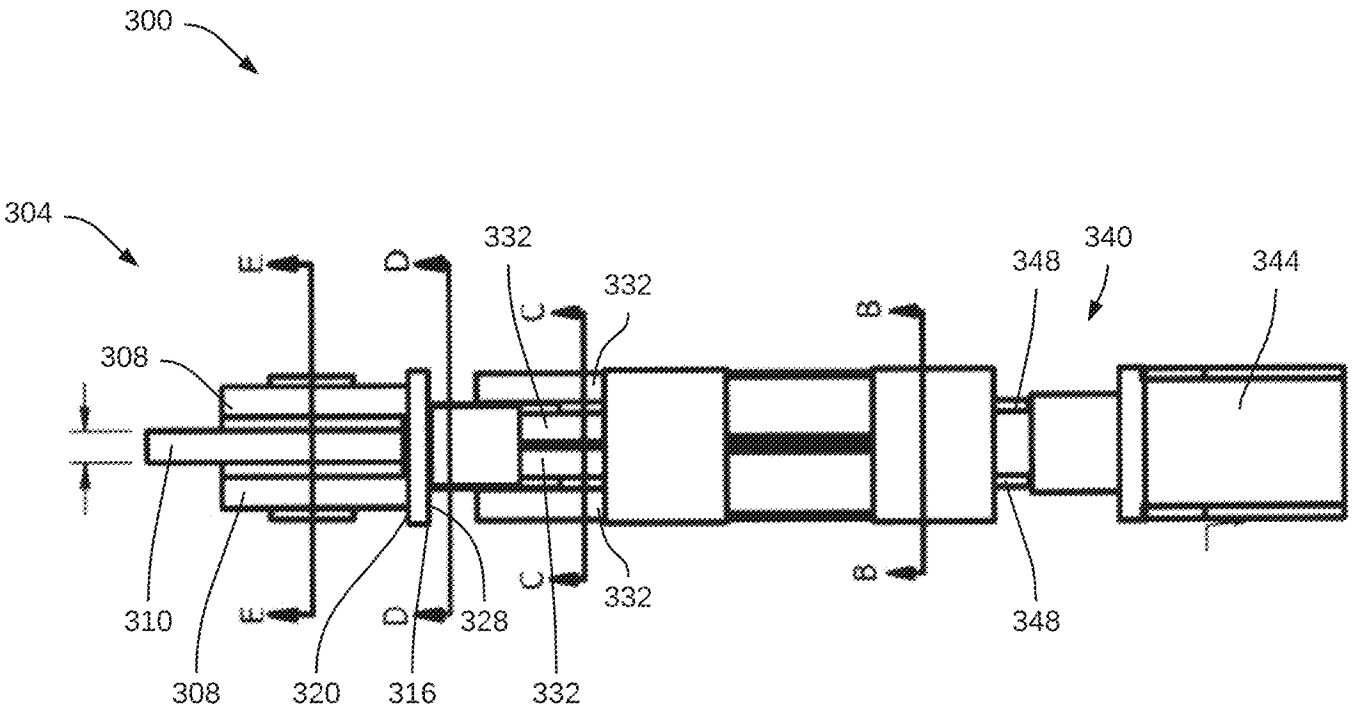
FIG. 4C illustrates a top plan view of the multi-damper assembly according to the example embodiment.
Figure 4E:
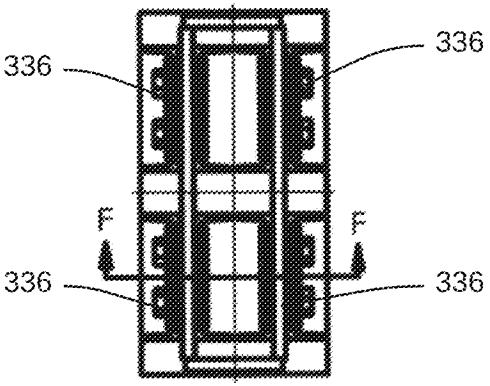
FIG. 4E illustrates a section view along the line C-C of FIG. 4C of the multi-damper assembly according to the example embodiment.
Figure 4G:
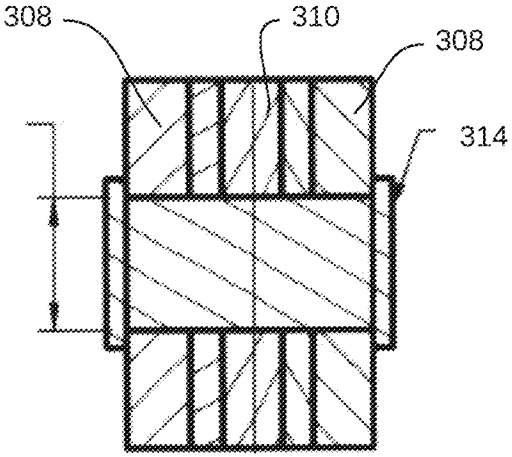
FIG. 4G illustrates a section view along the line E-E of FIG. 4C of the multi-damper assembly according to the example embodiment.
Figure 4D:
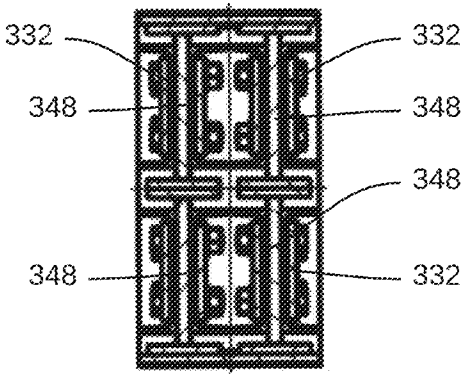
FIG. 4D illustrates a section view along the line B-B of FIG. 4C of the multi-damper assembly according to the example embodiment.
Figure 4F:
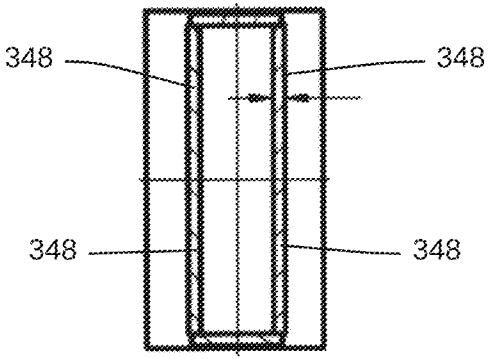
FIG. 4F illustrates a section view along the line D-D of FIG. 4C of the multi-damper assembly according to the example embodiment.
Figure 4H:
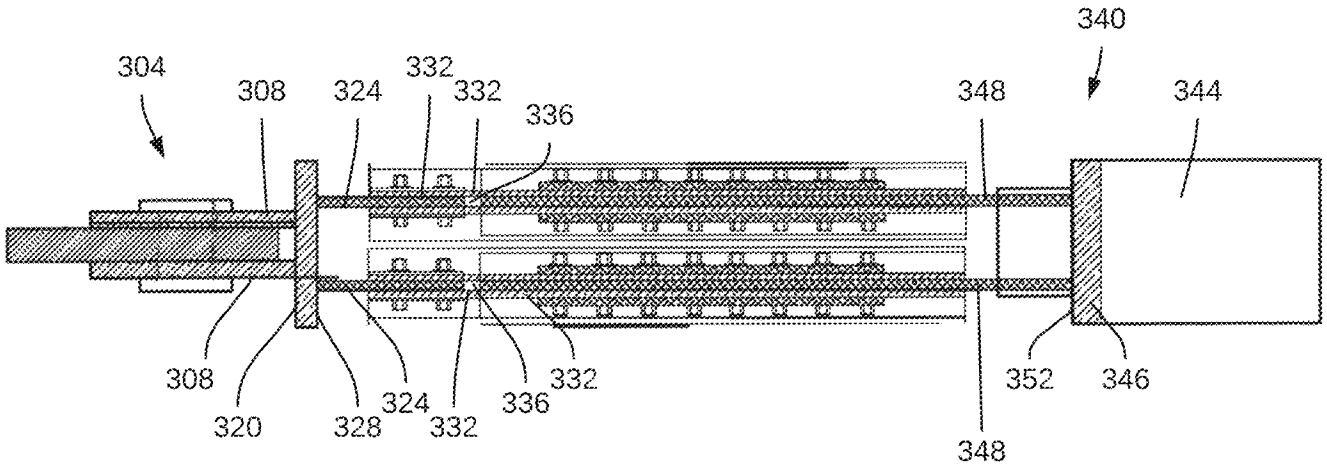
FIG. 4H illustrates a section view along the line F-F of FIG. 4E of the multi-damper assembly according to the example embodiment.

It will be appreciated that the features of the multi-load friction damper 100 described herein can be applied to the multi-layer friction damper 200. For example, each of the brace-side plates 222, 228 can be implemented as offset brace-side plates received within a single slip channel of the multi-layer friction damper 200. Referring now to FIGS. 4A and 4B, therein illustrated is a perspective view and side elevation view respectively, of a multi-damper friction damper assembly 300. The damper assembly 300 includes a gusset engagement member 304 that is engageable with a gusset of the building structure. For example, and as illustrated, the gusset engagement member 304 includes opposed gusset attachment plates 308 extending in a bracing axis 312 defined by the multi-damper friction damper assembly 300. In the illustrated example, the gusset engagement member 304 are attached to a gusset 310 of the building structure. A pin 314 extends through openings of the attachment plates 308 and gusset 310.

However, according to an alternative example embodiment, the gusset engagement member can be configured to engage a brace of the building structure.

The gusset engagement member 304 further includes a cross plate 316 oriented transversely to the bracing axis 312. It will be appreciated that the gusset attachment plates 308 extend from a first surface 320 of the cross plate 316.

The gusset engagement member 304 further includes at least two frontal attachment plates 324 extending along the bracing axis 312 from a second surface 328 of the cross plate 320. At least one pair of gusset-side plates 332 are coupled to the side surfaces of each frontal attachment plates 324. For each pair of gusset-side plates 332, a first of the gusset-side plates 332 is coupled to a first side surface of the frontal attachment plate 324 and a second of the gusset-side plates 332 is coupled to a second side surface of the frontal attachment plates 324. Accordingly, the pair of gusset-side plates 332 are spaced apart by a distance corresponding to the thickness of the frontal attachment plates 324. Each pair of gusset-side plates 332 correspond to the gusset-side plates 332 of a friction damper of the damper assembly 300. The pair of gusset-side plates 332 further define a respective slip channel 336 of the friction damper. In the illustrated example, two pairs of gusset-side plates 332 extend from each frontal attachment plate 324.

The damper assembly 300 further includes a brace engagement member 340 that is engageable with a brace of the building structure. For example, and as illustrated, the brace engagement member 340 includes a splay 344 that is part of a brace, or is couplable to the brace. The brace engagement member 340 further includes a cross-plate 346 oriented transversely to the bracing axis 312. It will be appreciated that the splay 344 extend from a brace-side surface of the cross-plate 346.

However, according to an alternative example embodiment, the brace engagement member can be configured to engage a gusset of the building structure.

A plurality of brace-side plates 348 extend along the bracing axis 312 from a damper-side surface 352 of the cross-plate 346. In the illustrated example, four brace-side plates 348 extend from the damper-side surface 352 and have a 2×2 arrangement.

Each brace-side plate 348 is received within a respective slip channel 336 of a corresponding pair of gusset-side plates 332. A brace-side plate 348 and its corresponding pair of gusset-side plates 332 form together the frictionally engaging elements of a friction damper of the damper assembly 300. More particularly, within each friction damper, a first friction surface of the brace-side plate 348 forms a first frictional engagement of the friction damper with an inner surface of one of the pair of gusset-side plates 332. Furthermore, a second friction surface of the brace-side plate 348 forms a second frictional engagement of the friction damper with an inner surface the other of the pair of gusset plates 332. It will be appreciated that two frictional engagements are formed within each of the plurality of friction dampers of the multi-damper assembly 300.

As illustrated, for each friction damper of the multi-damper assembly 300, first and second clamping members are disposed on the outer surface of the pair of gusset-side plates 332. Fasteners extend through openings of the gusset-side plates 332 and slotted openings brace-side plate to fasten the clamping members together. The clamping by the fasteners apply the normal forces on the surfaces of the pair of gusset-side plates 332 and brace-side plate 348, thereby causing the frictional engagements of the friction damper.

It will be appreciated that the multi-damper assembly 300 includes at least two friction dampers positioned between the gusset engagement member 304 and the brace engagement member 340. Furthermore, each of the friction dampers include at least two frictional engagements. Accordingly, the frictional engagements across each of the friction dampers of multi-damper assembly 300 define together a combined frictional force.

In a non-slip state of the multi-damper assembly 300, the frictional engagements of each of the friction dampers of the assembly 300 are maintained. The combined force of the plurality of friction dampers is sufficiently high to maintain the frictional engagements under seismic forces applied along the bracing axis 312 (compression or tension) within the building structure (i.e. when an earthquake is not occurring).

When a seismic force (compression or tension from an earthquake) applied along the bracing axis 312 is greater than the combined frictional force, the brace-side frictional plate 348 slips relative to the pair of gusset-side plates 332 within each of the friction dampers of the assembly 300. That is, the brace-side plates 348 slip together within their respective slip channels 336 under a load applied on the bracing axis 312 that is greater than the combined frictional force. This synchronized slipping converts the seismic force into friction heat.

As described elsewhere herein, the multi-damper assembly 300 includes a plurality of friction dampers. The assembly 300 may have a different number of friction dampers and these dampers may be arranged in different configurations.

Figure 4I:
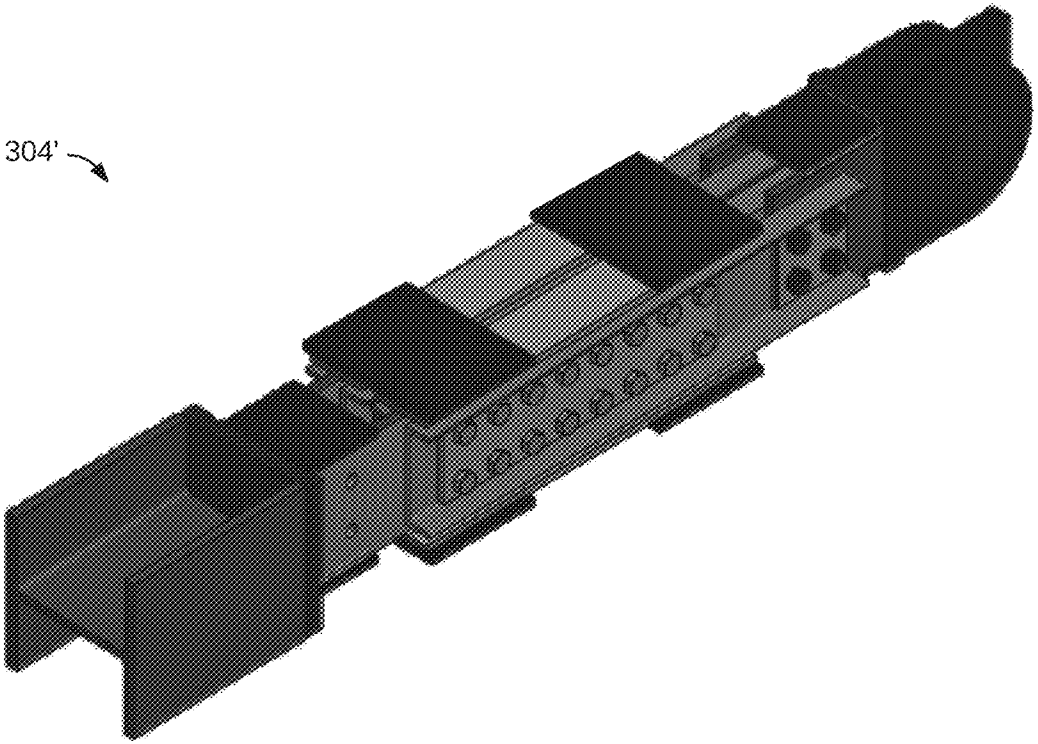
FIG. 4I illustrates a perspective view of a multi-damper assembly according to a first alternative example embodiment.

According to one example, and as illustrated in FIG. 4I, the multi-damper assembly 300' includes a first set of at least two friction dampers that are arranged side by side in a direction transverse to the bracing axis 312. In the illustrated example, the friction dampers have a 2 (width) by 1 (height) arrangement.

The example multi-damper assembly may further include second set of at least two friction dampers that are arranged side by side in the direction transverse to the bracing axis. The first and second set of friction dampers are further arranged one atop another in a heightwise direction of the friction damper. For example, referring back to FIGS. 4A to 4H, the example multi-damper assembly 300 four friction dampers arranged in a 2 (width) by 2 (height) arrangement.

Figure 4J:
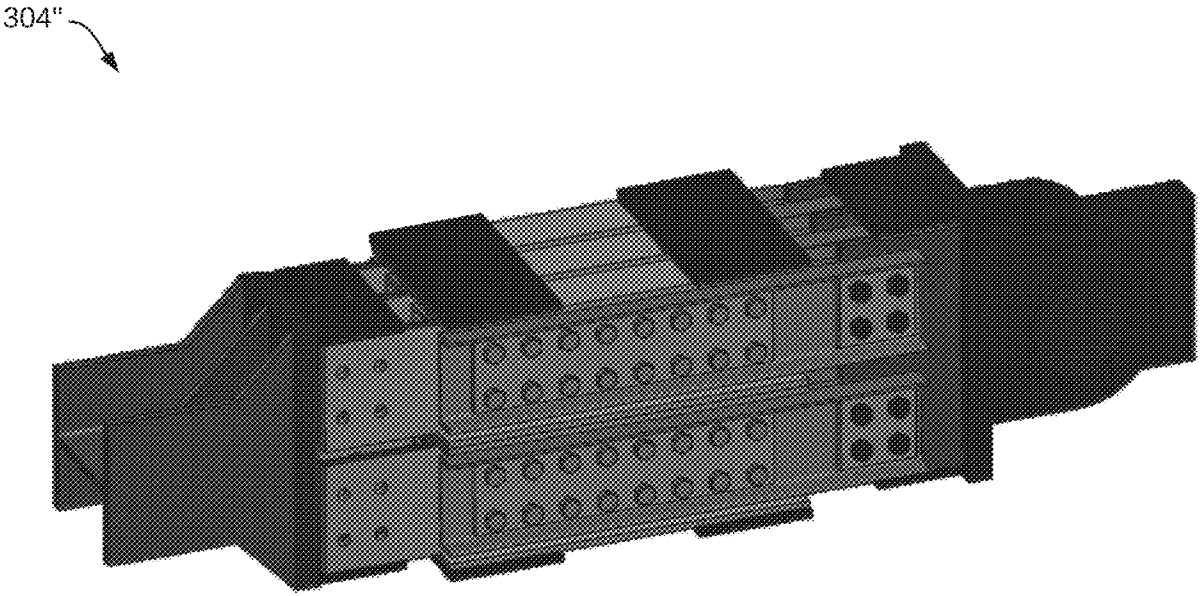
FIG. 4J illustrates a perspective view of a multi-damper assembly according to a second alternative example embodiment.

Referring further to FIG. 4J, the exemplary multi-damper assembly 300" therein has six friction dampers arranged in a 3 (width) by 2 (height) arrangement.

Advantageously, it was observed that the multi-damper assembly described herein can absorb a greater seismic force applied along the bracing axis than a prior art single friction damper. Furthermore, the multi-damper assembly can convert a greater amount of seismic energy into friction heat than the prior art single friction damper. This can allow a building structure having the multi-damper assembly to withstand earthquakes of greater magnitudes.

It was further observed that an intuitive way to increase the frictional force of the prior art friction damper is to increase the area of contact between difference surfaces of the plates of the friction damper. However, it was further observed that construction of plates with larger friction surfaces introduced a difficulty of being able to consistently manufacture the plates within acceptable tolerances.

Advantageously, the multi-damper assembly increases the combined frictional force of the assembly while using plates having friction surfaces having areas that are about the same size (or even smaller) than those of a prior art single friction damper. Accordingly, fabrication of plates within acceptable tolerances could still be achieved.

It will be understood that the features of the multi-load friction damper 100 described herein can be applied to the multi-damper assembly 300. One or more of the friction dampers of the multi-damper assembly 300 can be the multi-load friction damper 100. Each of the friction dampers can be the multi-load friction damper 100.

It will be understood that the features of the multi-layer friction damper 200 described herein can be applied to the multi-damper assembly 300. One or more of the friction dampers of the multi-damper assembly 300 can be the multi-layer friction damper 200. Each of the friction dampers can be the multi-layer friction damper 200.

It will be understood that the features of the multi-load friction damper in combination with the multi-layer friction damper 200 described herein can be applied to the multi-damper assembly 300. One or more of the friction dampers can be the combined multi-load/multi-layer friction damper. Each of the friction dampers can be the combined multi-load/multi-layer friction damper. While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A multi-damper assembly for a building structure, the assembly comprising:

a gusset engagement member;

a brace engagement member defining a bracing axis;

a plurality of friction dampers each having:

a pair of opposing gusset-side plates extending from the gusset engagement member along the bracing axis towards the brace engagement member, the plates being spaced apart to define a slip channel; and a brace-side plate extending from the brace engagement member along the bracing axis towards the gusset engagement member, the brace-side plate being received within the slip channel and being pinched between the pair of opposing gusset-side plates;

wherein the brace engagement member includes a cross-plate member oriented in a direction transverse to the bracing axis, the brace-side plates of the plurality of the friction dampers extending from a surface of the cross-plate member, and wherein the gusset engagement member includes a cross-plate member oriented in a direction transverse to the bracing axis and at least two frontal attachment plates extending from a surface of the cross-plate member of the gusset engagement member, at least one pair of gusset-side plates of the plurality of friction dampers being coupled to side surfaces of each frontal attachment plate.

2. The multi-damper assembly of claim 1, wherein within each friction damper, the brace-side plate has a first friction surface and a second friction surface and each of the pair of gusset-side plates has an inner friction surface, the first friction surface of the brace-side plate forms a first frictional engagement of the damper with the inner surface of one of the gusset-side plates and the second friction surface of the brace-side plate forms a second frictional engagement of the damper with the inner surface of the other of the gusset-side plates;

wherein the first and second frictional engagements of each of the plurality of friction dampers define a combined frictional force; and wherein the brace-side plates slip together within respective said slip channels under a load greater than the combined frictional force.

3. The multi-damper assembly of claim 1, wherein the plurality of friction dampers are oriented parallelly to one another and are aligned with the bracing axis.

4. The multi-damper assembly of claim 1, wherein the plurality of friction dampers comprises a first set of at least two friction dampers arranged side by side in a direction transverse to bracing axis;

wherein the plurality of friction dampers further comprises a second set of at least two friction dampers arranged side by side in the direction transverse to the bracing axis, the first and second set of friction dampers further being arranged one atop another in a heightwise direction of the friction damper;

wherein at least two pairs of gusset-side plates of the plurality of friction dampers being coupled to side surfaces of each frontal attachment plate;

wherein the at least two pairs of gusset side plates being coupled to a same frontal attachment plate of the at least two front attachment plates belong to friction dampers being arranged immediately atop one another in the heightwise direction of the friction damper;

wherein within each friction damper, the brace-side plate has a first friction surface and a second friction surface and each of the pair of gusset-side plates has an inner friction surface, the first friction surface of the brace-side plate forms a first frictional engagement of the damper with the inner surface of one of the gusset-side plates and the second friction surface of the brace-side plate forms a second frictional engagement of the damper with the inner surface of the other of the gusset-side plates;

wherein the first and second frictional engagements of each of the plurality of friction dampers define a combined frictional force; and wherein the brace-side plates slip together within respective said slip channels under a load greater than the combined frictional force.

5. The multi-damper assembly of claim 4, wherein the plurality of friction dampers are oriented parallelly to one another and are aligned with the bracing axis.

6. The multi-damper assembly of claim 1, wherein the plurality of friction damper comprises a first set of at least two friction dampers arranged side by side in a direction transverse to bracing axis.

7. The multi-damper assembly of claim 6, wherein within each friction damper, the brace-side plate has a first friction surface and a second friction surface and each of the pair of gusset-side plates has an inner friction surface, the first friction surface of the brace-side plate forms a first frictional engagement of the damper with the inner surface of one of the gusset-side plates and the second friction surface of the brace-side plate forms a second frictional engagement of the damper with the inner surface of the other of the gusset-side plates;

wherein the first and second frictional engagements of each of the plurality of friction dampers define a combined frictional force; and wherein the brace-side plates slip together within their respective slip channels under a load greater than the combined frictional force.

8. The multi-damper assembly of claim 6, wherein the plurality of friction dampers further comprises a second set of at least two friction dampers arranged side by side in the direction transverse to the bracing axis, the first and second set of friction dampers further being arranged one atop another in a heightwise direction of the friction damper.

9. The multi-damper assembly of claim 8, wherein at least two pairs of gusset-side plates of the plurality of friction dampers being coupled to side surfaces of each frontal attachment plate.

10. The multi-damper assembly of claim 9, wherein the at least two pairs of gusset side plates being coupled to a same frontal attachment plate of the at least two front attachment plates belong to friction dampers being arranged immediately atop one another in the heightwise direction of the friction damper.

11. The multi-damper assembly of claim 10, wherein within each friction damper, the brace-side plate has a first friction surface and a second friction surface and each of the pair of gusset-side plates has an inner friction surface, the first friction surface of the brace-side plate forms a first frictional engagement of the damper with the inner surface of one of the gusset-side plates and the second friction surface of the brace-side plate forms a second frictional engagement of the damper with the inner surface of the other of the gusset-side plates;

wherein the first and second frictional engagements of each of the plurality of friction dampers define a combined frictional force; and wherein the brace-side plates slip together within their respective slip channels under a load greater than the combined frictional force.

* * * * *